US009701112B2

(12) United States Patent
Kuki et al.

(10) Patent No.: US 9,701,112 B2
(45) Date of Patent: Jul. 11, 2017

(54) INK-JET RECORDING APPARATUS, INK SUPPLY METHOD, POWER SHUTDOWN METHOD, AND METHOD FOR SHUTTING DOWN TEMPERATURE ADJUSTMENT UNIT OF INK-JET RECORDING DEVICE

(71) Applicant: Konica Minolta, Inc., Tokyo (JP)

(72) Inventors: Takakazu Kuki, Tokyo (JP); Takashi Muramatsu, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/831,257

(22) Filed: Aug. 20, 2015

(65) Prior Publication Data

US 2015/0352837 A1 Dec. 10, 2015

Related U.S. Application Data

(62) Division of application No. 13/805,374, filed as application No. PCT/JP2011/063786 on Jun. 16, 2011.

(30) Foreign Application Priority Data

Jun. 23, 2010 (JP) ..... 2010-142431
Jul. 30, 2010 (JP) ..... 2010-172223

(51) Int. Cl.
*B41J 2/165* (2006.01)
*B41J 2/045* (2006.01)
*B41J 2/175* (2006.01)

(52) U.S. Cl.
CPC ..... *B41J 2/0454* (2013.01); *B41J 2/04586* (2013.01); *B41J 2/16547* (2013.01); *B41J 2/17593* (2013.01)

(58) Field of Classification Search
None
See application file for complete search history.

(56) References Cited

U.S. PATENT DOCUMENTS 5,621,444 A * 4/1997 Beeson ..... B41J 2/17593 347/88
6,007,193 A 12/1999 Kashimura et al.
(Continued)

FOREIGN PATENT DOCUMENTS

EP 0 571 127 A2 11/1993
JP 62173953 A 4/1987
(Continued)

OTHER PUBLICATIONS

Translation of Japanese patent publication JP2005-126507.*
(Continued)

*Primary Examiner* — Alejandro Valencia
(74) *Attorney, Agent, or Firm* — Lucas & Mercanti, LLP

(57) ABSTRACT

An ink jet recording apparatus including: a head that ejects droplets of ink; a flow passage portion; and a temperature adjustment unit. The flow passage portion supplies the ink to the head. The flow passage portion includes, in a part thereof, a reservoir unit that reserves the ink. The temperature adjustment unit is capable of adjusting temperatures of the flow passage portion and the head independently of each other. The temperature adjustment unit controls the temperatures of the flow passage portion and the head so that the ink in the head becomes liquid from solid after ink in the flow passage portion is turned to liquid from solid.

18 Claims, 29 Drawing Sheets

(56) References Cited

U.S. PATENT DOCUMENTS

| | | | | |
|---|---|---|---|---|
| 6,034,705 | A * | 3/2000 | Tolle | H04N 1/40031 347/195 |
| 7,182,448 | B2 * | 2/2007 | Godil | B41J 2/17593 347/88 |
| 2005/0219282 | A1 | 10/2005 | Kachi | |
| 2008/0218554 | A1 | 9/2008 | Inoue | |
| 2009/0195588 | A1 | 8/2009 | Ogama | |
| 2012/0200621 | A1 | 8/2012 | Limb et al. | |

FOREIGN PATENT DOCUMENTS

| | | | |
|---|---|---|---|
| JP | 6413326 | A | 1/1989 |
| JP | 03114839 | A | 5/1991 |
| JP | 05212874 | A | 8/1993 |
| JP | 06336009 | A | 12/1994 |
| JP | 09164670 | A | 6/1997 |
| JP | H09141850 | A | 6/1997 |
| JP | 2005126507 | A | 5/2005 |
| JP | 2006193745 | A | 7/2006 |
| JP | 2006256326 | A | 9/2006 |
| JP | 2009132919 | A | 6/2009 |
| JP | 2009234263 | A | 10/2009 |
| JP | 2010012637 | A | 1/2010 |
| WO | 8808514 | A1 | 11/1988 |

OTHER PUBLICATIONS

Partial Supplementary European Search Report dated Oct. 24, 2016 from corresponding European Application; Application No/Patent No. 11798037.5-1701 / 2586614 PCT/JP2011063786; Applicant: Konica Minolta, Inc.; Total of 11 pages.

Extended European Search Report dated Feb. 6, 2017 from the corresponding European Application No. 11798037.5-1701 / 2586614 PCT/JP2011063786; Applicant: Konica Minolta Holdings, Inc.; Total of 26 pages.

* cited by examiner

INK-JET RECORDING APPARATUS, INK SUPPLY METHOD, POWER SHUTDOWN METHOD, AND METHOD FOR SHUTTING DOWN TEMPERATURE ADJUSTMENT UNIT OF INK-JET RECORDING DEVICE

CROSS REFERENCE TO RELATED APPLICATION

This application is a Divisional application of U.S. patent application Ser. No. 13/805,374 filed Dec. 19, 2012, which was a 371 of PCT/JP2011/063786 filed on Jun. 16, 2011 which, in turn, claimed the priority of Japanese Patent Application Nos. JP2010-142431 filed on Jun. 23, 2010 and JP 2010-172223 filed Jul. 30, 2010, all four applications are incorporated by reference herein.

TECHNICAL FIELD

The present invention relates to an ink jet recording apparatus, an ink supply method by the ink jet recording apparatus, a power shutdown method of the ink jet recording apparatus, and a method of shutting down a temperature adjustment unit of the ink jet recording apparatus.

BACKGROUND ART

There is an ink jet printer as an ink jet recording apparatus capable of performing recording on a variety of recording mediums such as plain paper and a plastic thin plate. The ink jet printer includes a head that ejects ink from nozzle holes. The ink is ejected as fine liquid droplets from the nozzle holes of the head toward the recording mediums, whereby the recording is made onto the recording mediums.

With regard to the ink, for the purpose of preventing an image quality deterioration owing to a liquid slippage after the ink concerned is shot, reducing a drying load, enhancing fixing properties to the recording mediums, and so on, such ink is sometimes used, which is in a solid state at ordinary temperatures, and is molten by being heated. The ink as described above has a merit in being easy to handle since the ink is in a solid state at a non-recording time because of the ordinary temperatures.

Moreover, there is known a printer configuration of heating a tank reserving the ink, a head and flow passages thereof so that the ink cannot solidify in insides of these respective units in the case of performing the recording by using the ink as described above (for example, refer to Patent Literatures 1 and 2).

In the printer with such a configuration, a pressure (back pressure) to be applied to the ink in the head is controlled while heating the ink, whereby appropriate ink ejection from the head is realized (for example, refer to Patent Literatures 1 and 2). Note that, as a specific pressure control method, there is known such a method, in which a difference in water head value between an ink level in insides of the nozzles of the inkjet head and a liquid level of the ink in an ink storage unit is controlled by a back pressure control device, and a meniscus position of the nozzles is controlled so that the ink does not flow out from the nozzles.

PRIOR ART LITERATURES

Patent Literatures

Patent Literature 1: JP-A-2010-12637
Patent Literature 2: JP-A-2009-234263

SUMMARY OF THE INVENTION

Problems to be Solved by the Invention

However, in the case where such ink in the head that performs the recording by the ink is molten prior to the ink in the ink flow passage located upstream of the head concerned, even if the pressure is appropriately controlled in a back pressure control unit, a state is brought where a negative pressure is not appropriately applied to a head meniscus portion, then pressure control in the head is not performed, and accordingly, the ink leaks from the head, and this consequently causes liquid leakage and air entry.

Moreover, also in the case where the recording is ended, if the heating of the ink present more on an upstream side in an ink supply passage than the head is first stopped, then the ink more on the upstream side in the ink supply passage than the head solidifies, and since the ink in the head is liquid, the negative pressure in the head is not maintained owing to influences of thermal expansion, shrinkage and the like of air remaining on a periphery of the head, and it is apprehended that such malfunctions may occur, that the ink may leak from the head, and that the air may enter the head on the contrary.

Moreover, when the back pressure control is turned to a stopped/standby state before viscosity of the ink in the inside of the ink jet head is increased and fluidity of the ink is lowered, then in such a case where the liquid level of the ink in the ink storage unit is arranged more upward than a nozzle surface of the ink jet head, the back pressure of the meniscus in the insides of the nozzles is increased more than the atmospheric pressure, and it is also apprehended that the ink may flow out from the nozzles.

As a result, such problems occur that the ink is wasted, and that it takes time to maintain the nozzles of the head.

In this connection, the present invention has been made in order to solve the above-described problems. It is an object of the present invention to provide an ink jet recording apparatus capable of eliminating the waste of the ink and reducing maintenance labor for the nozzles of the head, to provide an ink supply method of the ink jet recording apparatus, to provide a power shutdown method of the ink jet recording apparatus, and to provide a method of shutting down a temperature adjustment unit of the ink jet recording apparatus.

Means for Solving the Problems

The invention described in item 1 is an ink jet recording apparatus comprising:

- a head that ejects droplets of ink;
- a flow passage portion for supplying the ink to the head, the flow passage portion including, in a part thereof, a reservoir unit that reserves the ink; and
- a temperature adjustment unit capable of adjusting temperatures of the flow passage portion and the head independently of each other,
- wherein the temperature adjustment unit controls the temperatures of the flow passage portion and the head so that the ink in the head becomes liquid from solid after ink in the flow passage portion is turned to liquid from solid.

The invention described in item 2 is the ink jet recording apparatus of item 1, further comprising:

- a reservoir unit pressure adjustment unit that adjusts a pressure to be applied to the ink in the reservoir unit, wherein, after adjusting the pressure by the reservoir unit pressure adjustment unit, and turning the ink in the flow passage portion from solid to liquid, the temperature adjustment unit controls the temperatures of the flow passage portion and the head so that the ink in the head becomes liquid from solid.

The invention described in item 3 is the ink jet recording apparatus of item 2, wherein the reservoir unit pressure adjustment unit performs control to adjust the pressure to be applied to the ink in the head before the ink in the head becomes liquid.

The invention described in item 4 is the ink jet recording apparatus of items 2 or 3, wherein the temperature adjustment unit turns ink in the head to liquid after turning the ink in the flow passage portion to liquid, and thereafter, controls a temperature of the ink in the flow passage to become a temperature higher than a freezing point of the ink and lower than a melting point of the ink.

The invention described in item 5 is the ink jet recording apparatus of item 4, wherein, after turning the ink in the head to liquid, the temperature adjustment unit controls a temperature of the ink in the head to become the temperature higher than the freezing point of the ink in the head and lower than the melting point of the ink.

The invention described in item 6 is the ink jet recording apparatus of any one of items 2 to 5, wherein, while monitoring the temperatures of both of the flow passage portion and the head, the temperature adjustment unit controls the temperatures so that the temperature of the flow passage portion becomes higher than the temperature of the head.

The invention described in item 7 is an ink jet recording apparatus comprising:

a head that ejects droplets of ink;

a flow passage portion for supplying the ink to the head, the flow passage portion including, in a part thereof, a reservoir unit that reserves the ink;

a reservoir unit pressure adjustment unit that adjusts a pressure to be applied to the ink in the reservoir unit;

a temperature adjustment unit capable of adjusting temperatures of the flow passage portion and the head independently of each other;

an input unit that inputs a turning-off instruction for a power supply; and a control unit that controls the power supply, wherein, in a case where the turning-off instruction for the power supply is inputted by the input unit, the control unit adjusts the pressure by the reservoir unit pressure adjustment unit, controls the ink in the head to become solid by the temperature adjustment unit, and thereafter, turns off the power supply.

The invention described in item 8 is the ink jet recording apparatus of item 7, wherein, in the case where the turning-off instruction for the power supply is inputted by the input unit, the control unit controls the ink in the head to become solid by the temperature adjustment unit, then controls ink in the flow passage portion to become solid by the temperature adjustment unit, and thereafter, turns off the power supply.

The invention described in item 9 is the ink jet recording apparatus of items 7 or 8, wherein, while monitoring the temperatures of both of the flow passage portion and the head, the temperature adjustment unit controls the temperatures so that the temperature of the head portion becomes lower than the temperature of the flow passage portion.

The invention described in item 10 is an ink jet recording apparatus comprising:

a head that ejects droplets of ink;

a flow passage portion for supplying the ink to the head, the flow passage portion including, in a part thereof, a reservoir unit that reserves the ink;

a reservoir unit pressure adjustment unit that adjusts a pressure to be applied to the ink in the reservoir unit;

a temperature adjustment unit capable of adjusting temperatures of the flow passage portion and the head independently of each other;

a power saving mode input unit capable of inputting a turning-off instruction for the temperature adjustment unit; and a control unit that controls the power supply, wherein, in a case where the turning-off instruction is inputted by the power saving mode input unit, the control unit adjusts the pressure by the reservoir unit pressure adjustment unit, controls the ink in the head to become solid by the temperature adjustment unit, and thereafter, turns off the temperature adjustment unit.

The invention described in item 11 is the ink jet recording apparatus of item 10, in the case where the turning-off instruction is inputted by the power saving mode input unit, the control unit controls the ink in the head to become solid by the temperature adjustment unit, then controls ink in the flow passage portion to become solid by the temperature adjustment unit, and thereafter, turns off the temperature adjustment unit.

The invention described in item 12 is the ink jet recording apparatus of any one of items 7 to 11, wherein the reservoir unit pressure adjustment unit stops the adjustment of the pressure to be applied to the ink in the head after controlling the ink in the head to become solid by the temperature adjustment unit.

The invention described in item 13 is the ink jet recording apparatus of any one of items 2 to 12, wherein the reservoir unit pressure adjustment unit includes:

a chamber for adjusting an air pressure in the reservoir unit, the chamber being allowed to communicate with the reservoir unit;

a pump that is allowed to communicate with the chamber and performs supply and exhaust of air for the chamber;

a pressure detection unit that detects an air pressure in the chamber; and an air supply/exhaust control unit that controls the supply and exhaust of the air in the chamber, which are to be performed by the pump, so that the air pressure detected by the pressure detection unit can become a predetermined setting value.

The invention described in item 14 is the ink jet recording apparatus of any one of items 2 to 12, wherein the reservoir unit pressure adjustment unit includes:

a reservoir-unit-inside ink liquid level detection unit that detects an ink liquid level in the reservoir unit; and a liquid level control unit that, based on a relative height of the ink liquid level to be detected by the reservoir-unit-inside ink liquid level detection unit with respect to a nozzle surface of the head, adjusts ink supply in the reservoir unit so as to adjust a pressure in the reservoir unit, and controls the liquid level.

The invention described in item 15 is the ink jet recording apparatus of item 1, wherein the temperature adjustment unit includes:

first heating means for heating the ink in the head;

second heating means for heating ink in an ink storage unit;

a temperature sensor for detecting a temperature of the ink in the head; and a control unit that controls the first heating means, the second heating means and the reservoir unit pressure adjustment unit, and in a case of cooling the ink, the control unit turns the first heating means to an off state, and in a case where a detection result of the temperature sensor is a predetermined temperature of less, turns the reservoir unit pressure adjustment unit to a standby state or a stopped state, and thereafter, turns the second heating means to the off state.

The invention described in item 16 is the ink jet recording apparatus of item 15, wherein the temperature adjustment unit includes:

first heating means for heating the ink in the head;

second heating means for heating ink in an ink storage unit;

a temperature sensor for detecting a temperature of the ink in the head; and a control unit that controls the first heating means, the second heating means and the reservoir unit pressure adjustment unit, and wherein, in a case of heating the ink, the control unit turns the first heating means and the second heating means to an on state, and when a detection result of the temperature sensor becomes higher than a predetermined temperature, starts back pressure control by the reservoir unit pressure adjustment unit.

The invention described in item 17 is the ink jet recording apparatus of item 16, further comprising:

temperature adjusting means for forcibly cooling/heating the ink in the head, wherein the control unit executes heating by the temperature adjusting means at a time of heating the ink, and executes cooling by the temperature adjusting means at a time of cooling the ink.

The invention described in item 18 is the ink jet recording apparatus of any one of items 15 to 17, wherein a top plate that forms a nozzle surface of the head is formed of a raw material higher in thermal conductivity than at least one of the ink storage unit and the ink flow passage.

The invention described in item 19 is the ink jet recording apparatus of any one of items 15 to 18, wherein the ink storage unit and the ink flow passage have a heat insulation structure.

The invention described in item 20 is an ink supply method in an ink jet recording apparatus including: a head that ejects droplets of ink; and a flow passage portion for supplying the ink to the head, the flow passage portion including, in a part thereof, a reservoir unit that reserves the ink, and being capable of individually adjusting temperatures of the flow passage portion and the head, the ink supply method comprising:

a first step of adjusting an ink pressure in the reservoir unit, and setting the flow passage portion at a temperature at which the ink in the flow passage portion becomes liquid; and a second step of setting the head at a temperature equal to or more than a temperature at which the ink in the head becomes liquid, the second step being performed after the first step.

The invention described in item 21 is the ink supply method of item 20, further comprising:

a step of adjusting a pressure to be applied to the ink in the head, the step being performed before the second step.

The invention described in item 22 is the ink supply method of items 20 or 21, further comprising:

a third step of controlling the temperature of the flow passage portion so that the temperature of the ink in the flow passage portion becomes a temperature higher than a freezing point of the ink and lower than a melting point of the ink, the third step being performed after the first step.

The invention described in item 23 is the ink supply method of item 22, further comprising:

a fourth step of controlling the temperature of the head so that the temperature of the ink in the head becomes the temperature higher than the freezing point of the ink and lower than the melting point of the ink, the fourth step being performed after the third step.

The invention described in item 24 is an ink supply method in an ink jet recording apparatus including: a head that ejects droplets of ink; and a flow passage portion for supplying the ink to the head, the flow passage portion including, in a part thereof, a reservoir unit that reserves the ink, and being capable of individually adjusting temperatures of the flow passage portion and the head, the ink supply method comprising:

a step of adjusting an ink pressure in the reservoir unit, setting the flow passage portion at a temperature at which the ink in the flow passage portion becomes liquid so that the temperature of flow passage portion becomes higher than the temperature of the head, and simultaneously setting the head at a temperature at which the ink in the head becomes liquid or more.

The invention described in item 25 is a power shutdown method in an ink jet recording apparatus including: a head that ejects droplets of ink; a flow passage portion for supplying the ink to the head, the flow passage portion including, in a part thereof, a reservoir unit that reserves the ink; a temperature adjustment unit capable of individually adjusting temperatures of the flow passage portion and the head; and an input unit capable of inputting a turning-off instruction for a power supply, the power shutdown method comprising:

a first step of inputting the turning-off instruction for the power supply;

a second step of adjusting the ink in the reservoir unit to a predetermined temperature and setting the temperature of the head at a temperature at which the ink in the head becomes solid; and a third step of turning off the power supply after the first step.

The invention described in item 26 is the power shutdown method of item 15, further comprising:

a fourth step of setting the temperature of the flow passage portion at a temperature at which the ink in the flow passage portion becomes solid, the fourth step being performed after the second step.

The invention described in item 27 is the power shutdown method of item 25 or 26, further comprising:

a step of adjusting a pressure until the temperature of the head becomes the temperature at which the ink in the head becomes solid, the pressure being to be applied to the ink in the head.

The invention described in item 28 is a method of shutting down a temperature adjustment unit of an ink jet recording apparatus including: a head that ejects droplets of ink; a flow passage portion for supplying the ink to the head, the flow passage portion including, in a part thereof, a reservoir unit that reserves the ink; a temperature adjustment unit capable of individually adjusting temperatures of the flow passage portion and the head; and a power saving mode input unit capable of inputting a turning-off instruction for the temperature adjustment unit, the method comprising:

a first step of inputting the turning-off instruction for the power saving mode input unit;

a second step of adjusting the ink in the reservoir unit to a predetermined temperature and setting the temperature of the head at a temperature at which the ink in the head becomes solid; and a third step of turning off the temperature adjustment unit after the second step.

The invention described in item 29 is the method of shutting down a temperature adjustment unit of item 28, further comprising:

a fourth step of setting the temperature of the flow passage portion at a temperature at which the ink in the flow passage portion becomes solid, the fourth step being performed after the second step.

The invention described in item 30 is the method of shutting down a temperature adjustment unit of item 28 or 29, further comprising:

a step of adjusting a pressure until the temperature of the head becomes the temperature at which the ink in the head becomes solid, the pressure being to be applied to the ink in the head.

Effects of the Invention

In accordance with the inventions according to items 1, 2 and 20, the ink in the head can be turned to liquid after the ink in the flow passage portion including the reservoir unit is turned to liquid, and the ink leakage from the head can be suppressed. Moreover, by the fact that the ink leakage is suppressed, the air entry from the outside into the space formed in the head can be suppressed.

Hence, waste of the ink can be eliminated, and maintenance labor for the nozzles of the head can be reduced.

In accordance with the inventions according to items 3 and 21, the pressure to be applied to the ink in the head is adjusted before the ink in the head becomes liquid, and accordingly, when the ink of the head is molten, an appropriate pressure comes to be applied to the ink.

In such a way, the ink leakage from the head can be suppressed. Moreover, by the fact that the ink leakage is suppressed, the air entry from the outside into the space formed in the head can be suppressed.

Hence, the waste of the ink can be eliminated, and the maintenance labor for the nozzles of the head can be reduced.

In accordance with the inventions according to items 4 and 22, in particular, in the case where there is a hysteresis in the phase transition temperature of the ink, the ink in the head is turned to a liquid state after the ink in the flow passage including the reservoir unit is turned to a liquid state, and thereafter, the temperature of the ink in the flow passage portion is controlled to be the temperature higher than the freezing point and lower than the melting point. Accordingly, the temperature of the ink is lowered to the temperature at which the ink can be kept liquid after the ink is once molten, whereby energy consumption of the temperature adjustment unit can be reduced, and energy saving can be achieved.

In accordance with the inventions according to items 5 and 23, since the freezing point of the ink is lower than the melting point thereof, the temperature of the ink is lowered to the temperature at which the ink can be kept liquid after the ink is once molten, whereby the energy consumption of the temperature adjustment unit can be reduced, and the energy saving can be achieved.

In accordance with the inventions according to items 6, 9 and 24, the temperatures of the flow passage portion and the head can be controlled simultaneously, and accordingly, more rapid printing control with higher reliability is enabled in comparison with a configuration of sequentially performing the temperature control for these.

In accordance with the inventions according to items 7, 10, 25 and 28, the ink leakage from the head and the air mixing into the head, which may be caused by the fact that the pressure in the head is not maintained, can be suppressed.

In accordance with the inventions according to items 8, 11, 26 and 29, the leakage of the ink in the flow passage portion including the reservoir unit from the head and the air mixing into the head can be suppressed.

Hence, the waste of the ink can be eliminated, and the maintenance labor for the nozzles of the head can be reduced.

In accordance with the inventions according to items 12, 27 and 30, the negative pressure in the head can be appropriately maintained until the ink in the head solidifies, and the ink leakage from the head and the air mixing into the head can be suppressed.

Hence, the waste of the ink can be eliminated, and the maintenance labor for the nozzles of the head can be reduced.

In accordance with the invention according to item 13, the pressure to be applied to the ink in the head can be adjusted by the air pressure.

In accordance with the invention according to item 14, the control for the pressure to be applied to the ink in the head can be performed easily with low cost by using the water head difference between the ink liquid level in the reservoir unit and the nozzle surface of the head.

In accordance with the inventions according to items 15 to 19, even if the back pressure control device is turned to the stopped or standby state, such a phenomenon can be prevented that the ink is extruded from the nozzles since the back pressure of the meniscus becomes larger than the atmospheric pressure, and it is made possible to suppress the ink from being consumed wastefully.

Note that the "solid" mentioned in the present invention includes so-called gel, which has high viscosity and loses fluidity, and becomes solid in the whole of system.

MODE FOR CARRYING OUT THE INVENTION

By using the drawings, a description is made below of a best mode for carrying out the present invention. It should be noted that a variety of technically preferable limitations are imposed on embodiments, which will be mentioned below, in order to carry out the present invention; however, the scope of the invention is not limited to the embodiments and illustrated examples.

First Embodiment

1. Configuration of Ink Jet Recording Apparatus

First, a description is made of an ink jet recording apparatus with reference to the drawings. Specifically, an ink jet recording apparatus (ink jet printer) 100 is an ink jet printer that forms an image on a recording medium by ejecting liquid droplet-like ink from a head (recording head).

Figure 1:
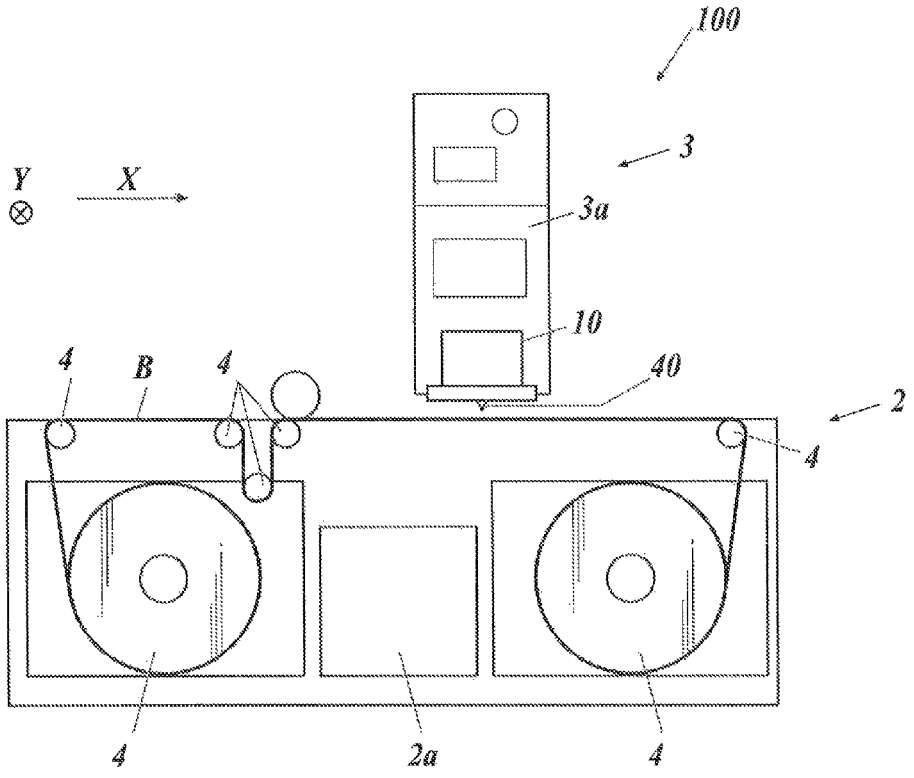
FIG. 1 is a side view showing an outline of an ink jet recording apparatus.
Figure 2:
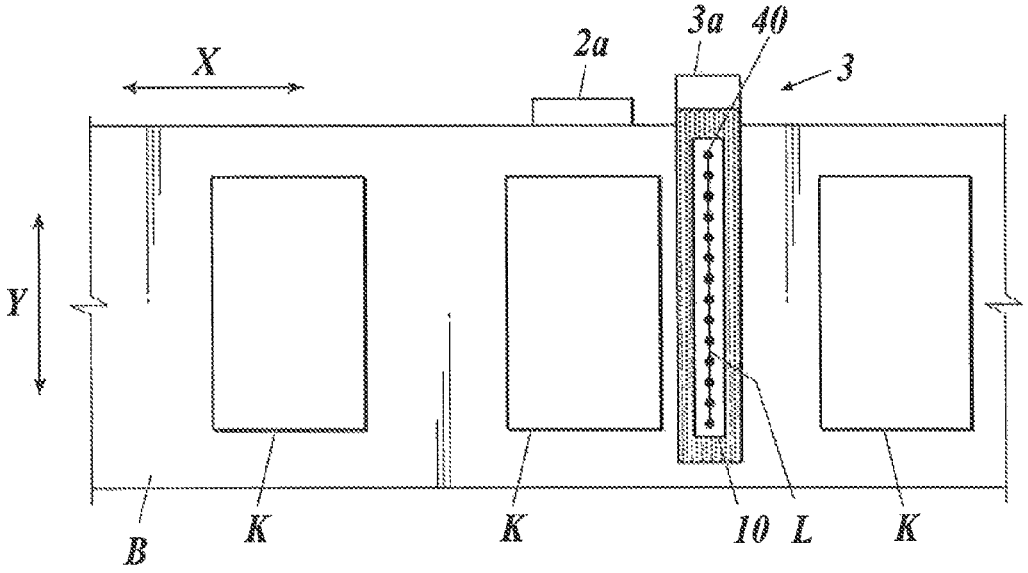
FIG. 2 is a view explaining operations of the ink jet recording apparatus.

FIG. 1 is a side view showing a schematic configuration of the inkjet recording apparatus 100 in this embodiment, and FIG. 2 is a view explaining operations of the ink jet recording apparatus 100 in this embodiment. Note that, in this embodiment, a description is made on the premise that the ink jet recording apparatus 100 is a one pass-type ink jet recording apparatus, that is, an ink jet recording apparatus that completes image recording while a recording medium K is being once conveyed.

The inkjet recording apparatus 100 is an apparatus that records an image on the recording mediums K based on image data transmitted from a personal computer (not shown) and the like, and as shown in FIG. 1 to FIG. 4, the ink jet recording apparatus 100 includes an ink supply device 1 (refer to FIG. 3), a conveying device 2, a print unit 3, a control unit 8 (refer to FIG. 4), and the like.

(1) Conveying Device, Print Unit

As shown in FIG. 1, the conveying device 2 is arranged at a position opposite to a head 10.

The conveying device 2 is a device that sequentially conveys a plurality of the recording mediums K in one direction (hereinafter, referred to as a conveying direction X) by a belt B that moves by rotation of conveying rollers 4 . . . , and the conveying device 2 has an operation panel 2*a* on one side surface thereof.

Here, as shown in FIG. 2, the recording mediums K are pasted onto a surface of the belt B, which is long, at a predetermined interval, and are conveyed following the belt B concerned.

The print unit 3 is a unit that records an image on the recording mediums K to be sequentially conveyed by the conveying device 2, and as shown in FIG. 1, the print unit 3 has an operation panel 3*a* on one side surface thereof. Here, in the case where the print unit 3 is viewed from a side of the operation panel 3*a*, the print unit 3 is made capable of recording an image individually onto the recording mediums K to be conveyed in a direction going from left to right with respect to page surfaces of FIG. 1 and FIG. 2 and onto the recording mediums K to be conveyed from right to left with respect thereto.

The print unit 3 has the head 10 that ejects ink toward the recording mediums K. Note that, in this embodiment, the print unit 3 has four heads 10, and the heads 10 concerned are provided individually so as to correspond to inks of four colors, which are Y (yellow); M (magenta); C (cyan); and K (black).

In each of the heads 10, a nozzle line L is provided, which is extended in a width direction Y of the belt B, that is, a direction perpendicular to the conveying direction X.

As shown in FIG. 1 and FIG. 2, this nozzle line L is composed of a plurality of nozzles 40 . . . , and is formed across both ends of the recording mediums K in the width direction Y.

These nozzles 40 . . . are configured to eject ink droplets based on a drive waveform and data indicating whether or not to perform the injection, the data being created for each of the nozzles 40 based on image data. More specifically, in the head 10, piezoelectric elements (not shown) for ejecting the ink in the nozzles 40 are provided, and these elements vibrate based on the drive waveform and the data indicating whether or not to perform the injection, whereby the ink in the nozzles 40 is made to be vibrated and ejected.

(2) Ink Supply Device

Figure 3:
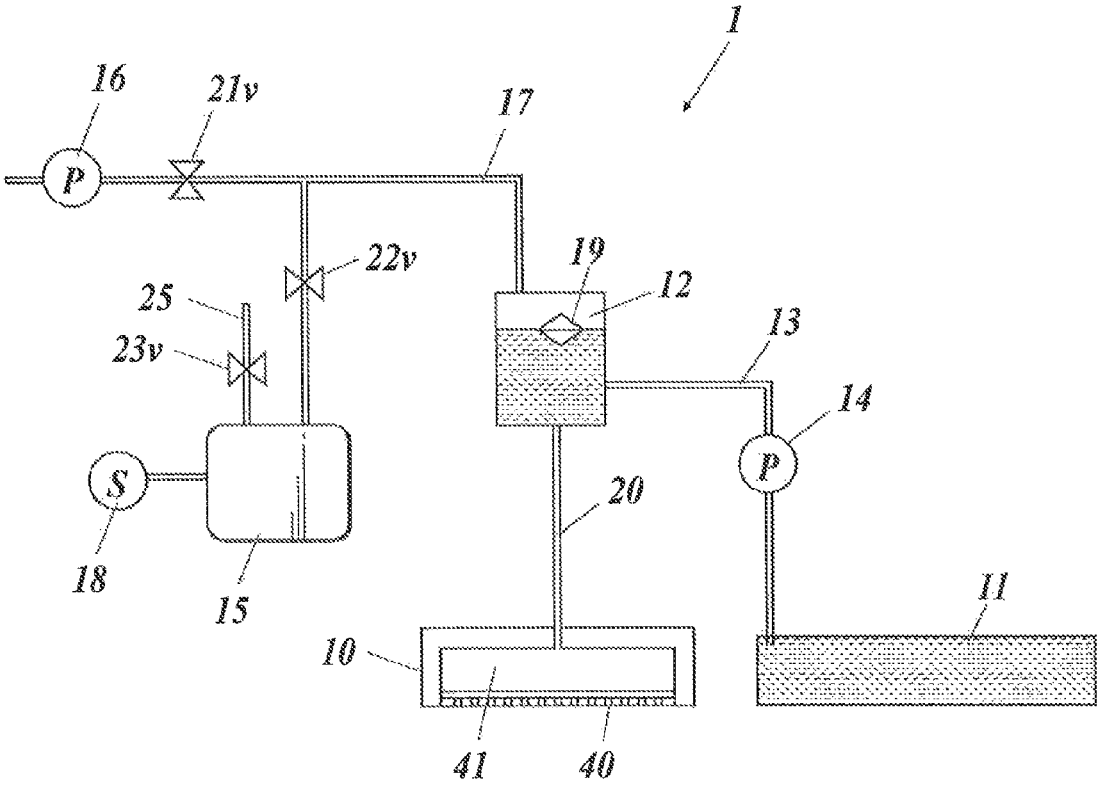
FIG. 3 is a schematic view of an ink supply device that performs back pressure adjustment for a head by an air pressure.
Figure 4:
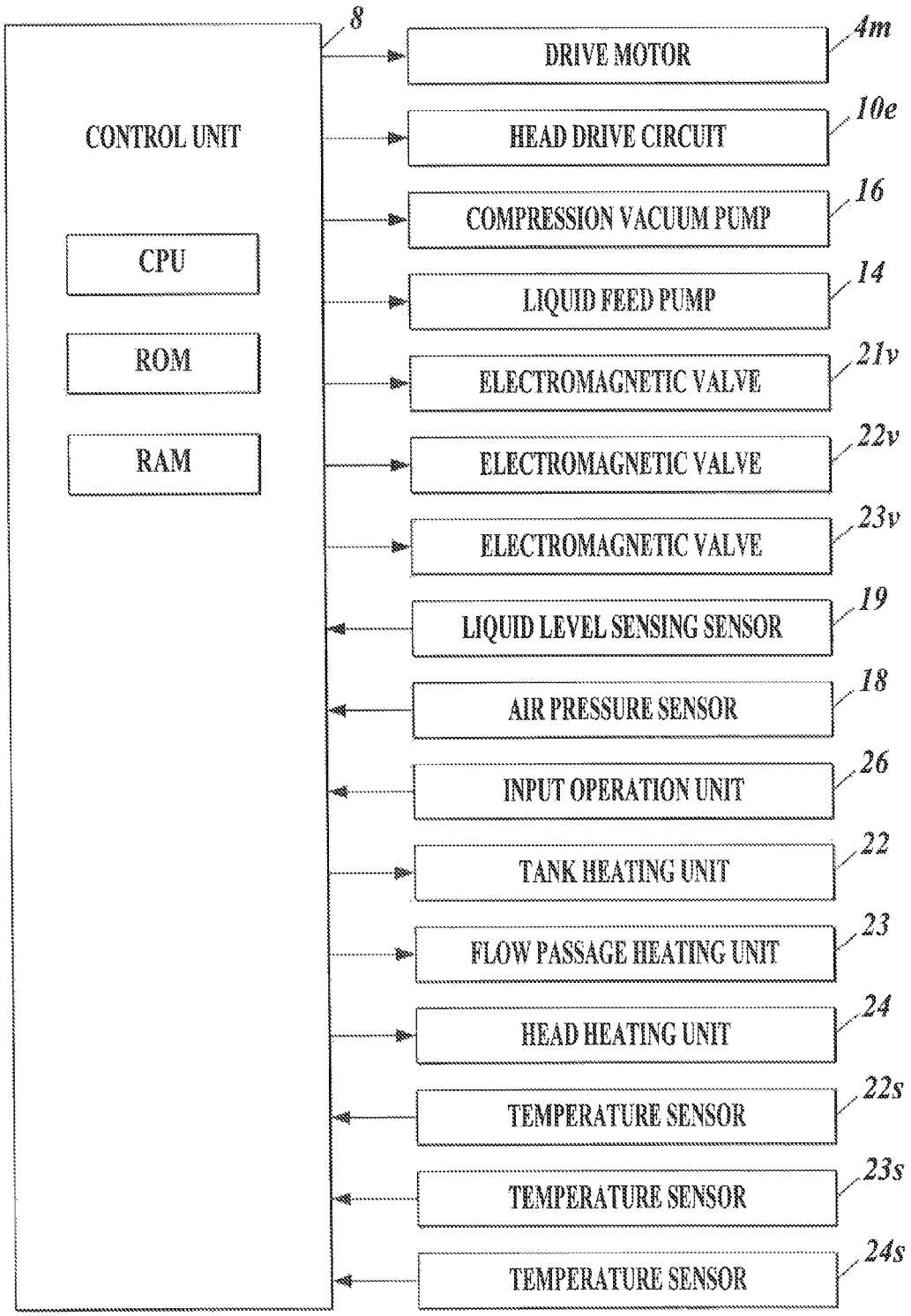
FIG. 4 is a block diagram showing configurations to be controlled by a control unit.

As shown in FIG. 3 and FIG. 4, the ink supply device 1 includes a main tank 11, a sub-tank 12, an ink flow passage 13, a liquid feed pump 14, an air chamber 15, a compression vacuum pump 16, an air flow passage 17, an air pressure sensor 18, a liquid level sensing sensor 19, an ink flow passage 20, electromagnetic valves 21*v*, 22*v* and 23*v*, tank heating units 22, flow passage heating units 23, a head heating unit 24, temperature sensors 22*s*, 23*s* and 24*s*, and the like.

The main tank 11 is a container as a reservoir unit that reserves the ink of each of the colors. The main tank 11 is provided individually for each color of the ink. The main tank 11 serves as an ink supply source that supplies the ink to the sub-tank 12. The ink reserved in the main tank 11 is ink, which is solid at ordinary temperatures, and is changed to liquid by being heated.

The sub-tank 12 is a container as a reservoir unit that temporarily reserves the ink to be supplied from the main tank 11. The sub-tank 12 is allowed to communicate with the main tank 11 by the ink flow passage 13, and the molten liquid ink passes from the main tank 11 through the ink flow passage 13, and flows into the sub-tank 12.

Note that, in this embodiment, four main tanks 11 and four sub-tanks 12 are provided individually so as to correspond to the respective inks of Y (yellow), M (magenta), C (cyan) and K (black) though all thereof are not shown.

In the ink flow passage 13, the liquid feed pump 14 is provided. The liquid feed pump 14 feeds the ink from the main tank 11 into the sub-tank 12.

The air chamber 15 is a container in which an inside is hollow. The air chamber 15 is allowed to communicate with the sub-tank 12 through the air flow passage 17. The air chamber 15 is configured to be filled with air, and when an air pressure is adjusted in the air chamber 15, the air pressure functions also to the liquid level of the ink in the sub-tank 12, and an air pressure in the sub-tank 12 can be adjusted. To the air chamber 15, there is connected an air pressure sensor 18 as a pressure detection unit that measures the air pressure in the air chamber 15 concerned.

To the air chamber 15, there is connected an air flow passage 25 for purging the air in the air chamber 15. The electromagnetic valve 23*v* is incorporated in the air flow passage 25, and opens and closes the air flow passage 25. Opening and closing of the electromagnetic valve 23*v* are controlled by the control unit 8. When the electromagnetic valve 23*v* is opened, the atmosphere on the outside and the inside of the air chamber 15 are allowed to communicate with each other, and the air pressure in the air chamber 15 can be set at the same air pressure as the atmospheric pressure.

On the way to the air chamber 15, the air flow passage 17 is branched into two, one thereof is connected to the air chamber 15, and the other thereof is connected to the compression vacuum pump 16. In a flow passage portion of the branched air flow passage 17, which is to be connected to the air chamber 15, the electromagnetic valve 22*v* is incorporated, and opens and closes the air flow passage 17. Opening and closing of the electromagnetic valve 22*v* are controlled by the control unit 8. When the electromagnetic valve 22*v* is opened, then the air chamber 15 and the sub-tank 12 are allowed to communicate with each other, and the air pressure in the air chamber 15 can be transmitted to the sub-tank 12.

In a flow passage portion of the branched air flow passage 17, which is to be connected to the compression vacuum pump 16, the electromagnetic valve 21*v* is incorporated, and opens and closes the air flow passage 17. Opening and closing of the electromagnetic valve 21*v* are controlled by the control unit 8. When the electromagnetic valve 21*v* is opened, then the compression vacuum pump 16 and the sub-tank 12 are allowed to communicate with each other, and the air pressure in the sub-tank 12 can be adjusted by the compression vacuum pump 16.

The compression vacuum pump 16 can increase the air pressure in the air chamber 15 by supplying air into the air chamber 15, and can lower the air pressure in the air chamber 15 by discharging the air in the air chamber 15.

In the sub-tank 12, the liquid level sensing sensor 19 is provided, which serves as a reservoir-unit-inside ink liquid level detection unit that detects an ink liquid level in the sub-tank 12. The liquid level sensing sensor 19 is provided at an upper limit position of a reserved water level of the ink in the sub-tank 12, and is a sensor that senses that the sub-tank 12 is filled with the ink.

To the sub-tank 12, the head 10 that ejects the ink to the recording mediums is connected through the ink flow passage 20. The head 10 is allowed to communicate with the sub-tank 12 by the ink flow passage 20, and the ink can pass from the sub-tank 12 through the ink flow passage 20, and can flow into the head 10. Hence, the sub-tank 12 is present between the ink flow passage 13 and the ink flow passage 20, and the flow passage portion is configured by including the sub-tank 12 and the ink flow passages 13 and 20.

In an inside of the head 10, an ink chamber 41 that supplies the ink to the nozzles 40 is formed.

The tank heating units 22 are provided in the main tank 11 and the sub-tank 12. The tank heating units 22 heat the tanks 11 and 12, thereby transmit heat thereof to the ink in the tanks 11 and 12, and melt the solid ink. Hence, the tank heating units 22 can transmit such an amount of heat that can heat the ink to a temperature equal to or more than a melting point of the ink to the tanks 11 and 12.

The flow passage heating units 23 are provided in the ink flow passages 13 and 20. The flow passage heating units 23 heat the ink flow passages 13 and 20, thereby transmit heat thereof to the ink in the ink flow passages 13 and 20, and melt the solid ink. Hence, the flow passage heating units 23 can transmit such an amount of heat that can heat the ink to the temperature equal to or more than the melting point of the ink to the ink flow passages 13 and 20.

The head heating unit 24 is provided in the head 10. The head heating unit 24 heats the head 10, thereby transmits heat thereof to the ink in the head 10, and melts the solid ink. Hence, the head heating unit 24 can transmit such an amount of heat that can heat the ink to the temperature equal to or more than the melting point of the ink to the head 10.

The temperature sensors 22*s* are provided in the main tank 11 and the sub-tank 12, and detect temperatures of the main tank 11 and the sub-tank 12, which are to be heated.

The temperature sensors 23*s* are provided in the ink flow passages 13 and 20, and detect temperatures of the ink flow passages 13 and 20 to be heated.

The temperature sensor 24*s* is provided in the head, and detects a temperature of the head 10 to be heated.

(3) Control Unit

As shown in FIG. 4, the control unit 8 also controls drives of the respective units of the ink jet printer 100, such as turning on/off a power supply of the ink jet printer 100, and converting image data of an image, which is inputted from an external device and should be recorded on the recording mediums K, into data corresponding to the respective nozzles 40 of the head 10.

As shown in FIG. 4, the control unit 8 is composed of a general-purpose computer, in which a CPU, a ROM, a RAM, an input/output interface and the like are connected to a bus.

To the control unit 8, there are connected: a drive motor 4*m* that drives the conveying rollers 4 . . . ; a head drive circuit 10*e*; the compression vacuum pump 16; the liquid feed pump 14; the electromagnetic valves 21*v*, 22*v* and 23*v*; the liquid level sensing sensor 19; the air pressure sensor 18; an input operation unit 26 as an input unit that inputs an operation instruction and the on/off of the power supply; the tank heating units 22; the flow passage heating units 23; the head heating unit 24; the temperature sensors 22*s*, 23*s* and 24*s*; and the like.

The control unit 8 performs liquid feeding control for the ink by the liquid feed pump 14, and opening/closing control for the electromagnetic valves 21*v*, 22*v* and 23*v*.

The control unit 8 controls supply and exhaust of air in the air chamber 15 by the compression vacuum pump 16 so that the air pressure in the air chamber 15, which is detected by the air pressure sensor 18, can become a predetermined setting value set in advance. In such a way, the control unit 8 can adjust a pressure, which is to be applied to the ink in the head 10, to a negative pressure. That is to say, the control unit 8 functions as an air supply/exhaust control unit. Moreover, the air chamber 15, the compression vacuum pump 16, the air pressure sensor 18 and the control unit 8 are provided, whereby a reservoir unit pressure adjustment unit is configured.

The control unit 8 individually performs heating controls, which are to be performed by the tank heating units 22, the flow passage heating units 23 and the head heating unit 24, so that the temperatures of the head 10, the respective tanks 11 and 12 and the respective ink flow passages 13 and 20, which are detected by the temperature sensors 22*s*, 23*s* and 24*s*, can become a temperature that allows the solid ink to be molten. Specifically, the control unit 8 controls on/off of energization to the respective heating units 22, 23 and 24 so that the temperatures of the respective units becomes temperatures which enable the ink to be maintained in a liquid state. Specifically, the tank heating units 22, the flow passage heating units 23, the head heating unit 24, the temperature sensors 22*s*, 23*s* and 24*s*, and the control unit 8 are provided, whereby a temperature adjustment unit is configured.

Note that the controls for the respective units by the control unit 8 are realized in such a manner that the CPU executes a program stored in the ROM in advance.

2. Ink Supply Method

Next, a description is made of ink supply methods in the ink jet printer 100.

(1) Usual Ink Supply Method

Figure 5:
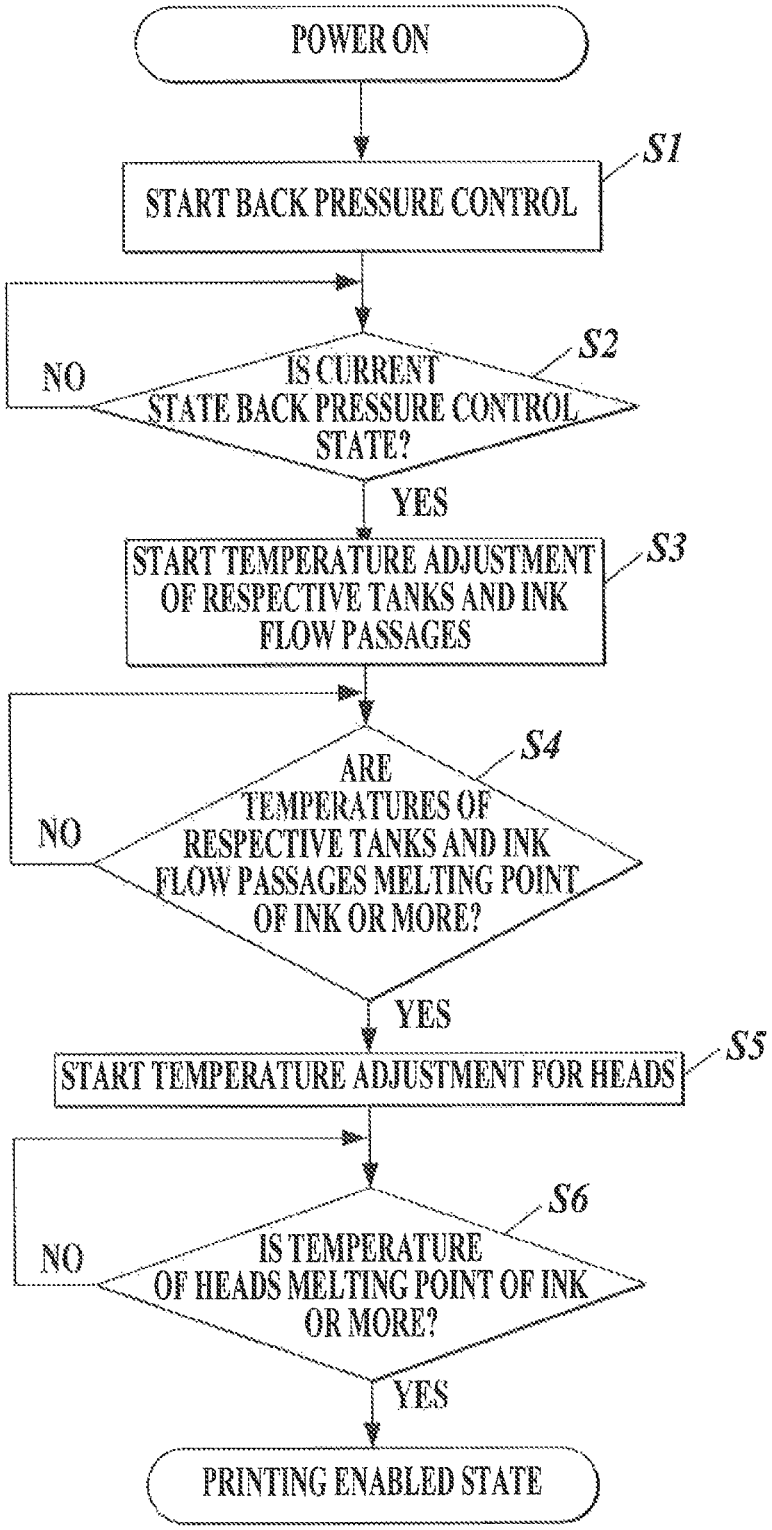
FIG. 5 is a flowchart showing a flow of an ink supply method.

As shown in FIG. 5, when the power supply of the ink jet printer 100 is turned on, the control unit 8 controls the supply/exhaust of the air in the air chamber 15 by the compression vacuum pump 16 so that the air pressure in the air chamber 15, which is detected by the air pressure sensor 18, becomes a predetermined setting value set in advance (Step S1).

In such a way, back pressure control in the head 10 is performed.

Subsequently, the control unit 8 determines whether or not the air pressure detected by the air pressure sensor 18 has become the setting value (Step S2).

In Step S2, in the case of having determined that the air pressure has become the setting value (Step S2: Yes), the control unit 8 performs temperature adjustment so that the main tank 11, the sub-tank 12 and the ink flow passages 13 and 20 can reach the temperature equal to or more than the melting point of the ink, that is, so that the ink in the insides of these can become liquid from solid (Step S3).

That is to say, the control unit 8 adjusts an ink pressure in the main tank 11 and the sub-tank 12 to a predetermined pressure, and performs the temperature adjustment so that the ink in the ink flow passages 13 and 20 including these ink tanks becomes liquid from solid.

In the temperature adjustment, the control unit 8 individually performs heating for the respective units by the tank heating units 22 and the flow passage heating units 23 so that the temperatures to be detected by the temperature sensors 22*s* and 23*s* becomes the temperatures (to be set in advance) equal to or more than the melting point of the ink.

Subsequently, the control unit 8 determines whether or not the temperatures detected by the temperature sensors 22*s* and 23*s* are the temperatures equal to or more than the melting point of the ink (Step S4).

In the case where the control unit 8 has determined in Step S4 that the temperatures detected by the temperature sensors 22*s* and 23*s* are the temperatures equal to or more than the melting point of the ink (Step S4: Yes), the control unit 8 performs the temperature adjustment so that the head 10 can reach the temperature equal to or more than the melting point of the ink, that is, so that the ink in the inside of the head 10 becomes liquid from solid (Step S5).

In the temperature adjustment, the control unit 8 individually performs heating for the respective units by the head heating unit 24 so that the temperature to be detected by the temperature sensor 24*s* becomes the temperature (to be set in advance) equal to or more than the melting point of the ink.

Subsequently, the control unit 8 determines whether or not the temperature detected by the temperature sensor 24*s* is the temperature equal to or more than the melting point of the ink (Step S6).

Then, in the case where the control unit 8 has determined in Step S6 that the temperature detected by the temperature sensor 24*s* is the temperature equal to or more than the melting point of the ink (Step S6: Yes), the control unit 8 determines that the current state is a state where it is possible to eject the ink from the head 10 in which the back pressure is controlled, drives the drive motor 4*m*, the head 10 and the like, and allows these to perform the formation of the image on the recording mediums.

As described above, the control unit 8 first adjusts the ink pressures of the respective tanks 11 and 12, then melts the ink in the respective tanks 11 and 12 and the ink flow passages 13 and 20, and thereafter, melts the ink in the head 10. In such a way, after the pressures to be applied to the ink in the respective tanks 11 and 12 and the ink flow passages 13 and 20 are adjusted, the ink in the head 10 can be molten, and ink leakage from the head 10 can be suppressed. Moreover, by the fact that the ink leakage is suppressed, air entry from the outside into a space formed in the head 10 can be suppressed.

Moreover, the control unit 8 adjusts the pressure, which is to be applied to the ink in the head 10, before adjusting the temperature of the head 10 to the temperature equal to or more than the melting point of the ink, and accordingly, when the ink in the head 10 is molten, an appropriate pressure is applied to the ink.

In such a way, the ink leakage from the head 10 can be suppressed. Moreover, by the fact that the ink leakage is suppressed, the air entry from the outside into the space formed in the head 10 can be suppressed.

Hence, waste of the ink can be eliminated, and maintenance labor for the nozzles of the head 10 can be reduced.

(2) Ink Supply Method in Case where Respective Tanks and Ink Flow Passages are Heated in Shorter Time than Head Next, a description is made of an ink supply method in the case where the respective tanks and ink flow passages are heated in a shorter time than the head, in other words, in the case where the respective tanks and ink flow passages are higher in thermal conductivity than the head, or in the case where each amount of heat of the tank heating units 22 and the flow passage heating units 23 at the time of heating is larger than that of the head heating unit 24.

Figure 6:
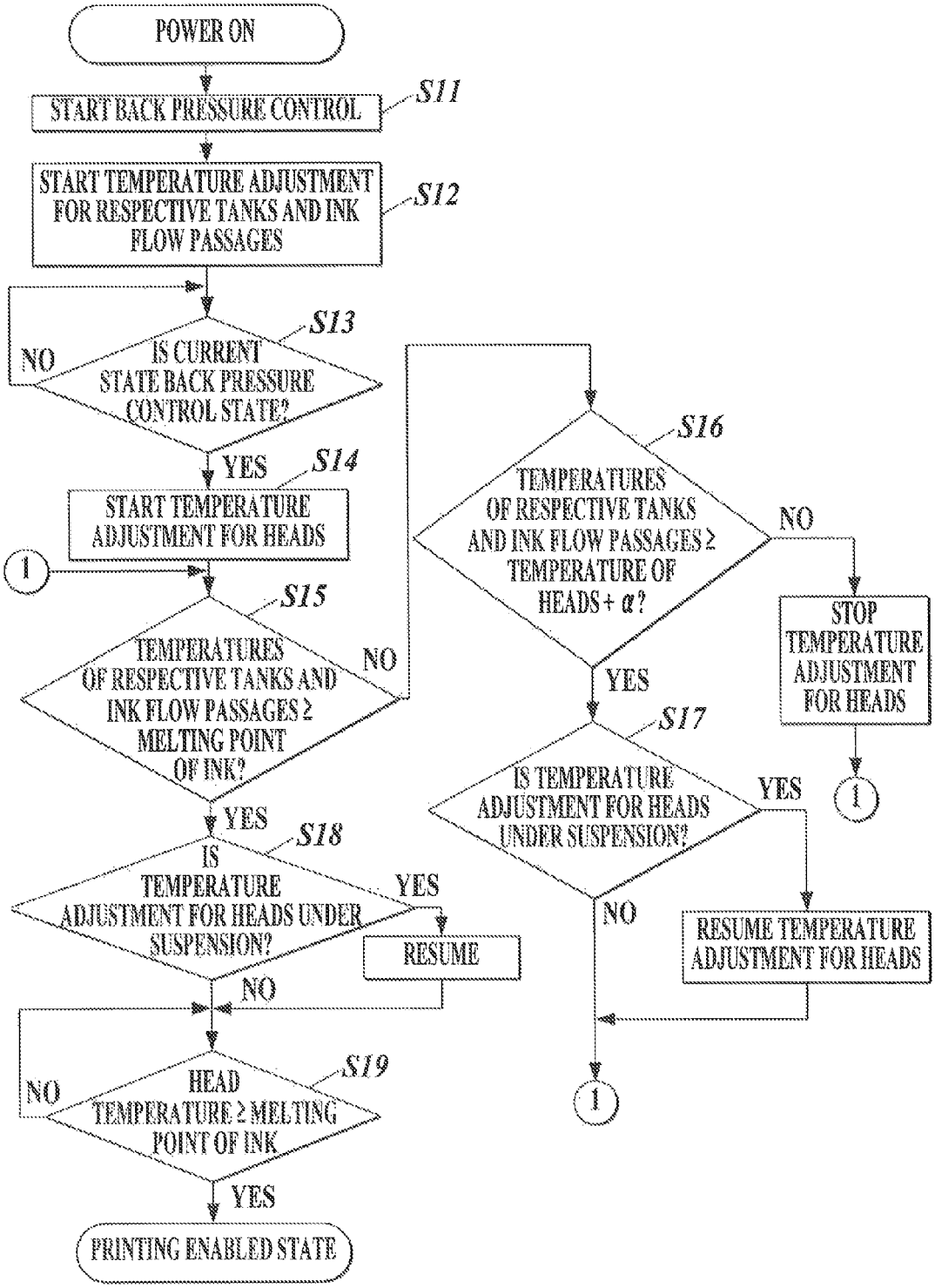
FIG. 6 is a flowchart showing a flow of an ink supply method when the respective tanks, ink flow passages and the head are designed so that the respective tanks and the ink flow passages can first reach a melting point of ink in a case of simultaneously heating these respective units.

As shown in FIG. 6, when the power supply of the ink jet printer 100 is turned on, the control unit controls the supply/exhaust of the air in the air chamber 15 by the compression vacuum pump 16 so that the air pressure in the air chamber 15, which is detected by the air pressure sensor 18, becomes a predetermined setting value set in advance (Step S11). In such a way, the back pressure control in the head 10 is performed.

Subsequently, the control unit 8 performs the temperature adjustment so that the main tank 11, the sub-tank 12 and the ink flow passages 13 and 20 can reach the temperature equal to or more than the melting point of the ink, that is, so that the ink in the insides of these becomes liquid from solid (Step S12).

That is to say, the control unit 8 adjusts the ink pressure in the main tank 11 and the sub-tank 12 to a predetermined pressure, and performs the temperature adjustment so that the ink in the ink flow passages 13 and 20 including these ink tanks can become liquid from solid.

Then, in the temperature adjustment, the control unit 8 individually performs the heating for the respective units by the tank heating units 22 and the flow passage heating units 23 so that the temperatures to be detected by the temperature sensors 22*s* and 23*s* becomes the temperatures (to be set in advance) equal to or more than the melting point of the ink.

Subsequently, the control unit 8 determines whether or not the air pressure in the air chamber 15, which is detected by the air pressure sensor 18, has become a predetermined setting value set in advance (Step S13).

In the case of having determined in Step S13 that the air pressure has become the setting value (Step S13: Yes), the control unit 8 performs the temperature adjustment so that the head 10 can reach the temperature equal to or more than the melting point of the ink, that is, so that the ink in the inside of the head 10 becomes liquid from solid (Step S14).

In the temperature adjustment, the control unit 8 individually performs the heating for the respective units by the head heating unit 24 so that the temperature to be detected by the temperature sensor 24*s* can become the temperature (to be set in advance) equal to or more than the melting point of the ink.

Then, after the temperature adjustment, the control unit 8 determines whether or not the temperatures detected by the temperature sensors 22*s* and 23*s* are the temperatures equal to or more than the melting point of the ink (Step S15).

In Step S15, in the case where the control unit 8 has determined that the temperatures detected by the temperature sensors 22*s* and 23*s* are the temperatures equal to or more than the melting point of the ink (Step S15: Yes), the control unit 8 determines whether or not the temperature adjustment by the head heating unit 24 is stopped (Step S18).

Meanwhile, in the case of having determined in Step S15 that the temperatures detected by the temperature sensors 22*s* and 23*s* are the temperatures less than the melting point of the ink (Step S15: No), the control unit 8 determines whether or not the temperatures detected by the temperature sensors 22*s* and 23*s* are temperatures higher than the temperature to be detected by the temperature sensor 24*s*, that is, whether or not the temperatures of the tanks and the ink flow passages are higher than a substantial temperature of the head, in which an amount of margin a such as a measurement error and temperature irregularity is added to the temperature of the head (Step S16).

In the case where it is determined in Step S16 that the temperatures detected by the temperature sensors 22*s* and 23*s* are higher temperatures than the temperature detected by the temperature sensors 24*s* (Step S16: Yes), the method proceeds to a step of determining whether or not the temperature adjustment by the head heating unit 24 is stopped (Step S17).

Moreover, in the case where it is determined that the temperatures detected by the temperature sensors 22*s* and 23*s* are lower temperatures than the temperature detected by the temperature sensors 24*s* (Step S16: No), then the temperature adjustment of the head heating unit 24 is first stopped, and thereafter, there is performed the step of determining whether or not the temperatures detected by the temperature sensors 22*s* and 23*s* are the temperatures equal to or more than the melting point of the ink (Step S15).

In the case where it is determined that the head heating unit 24 is stopped in Step S17 (Step S17: Yes), then the temperature adjustment by the head heating unit 24 is resumed, and thereafter, there is performed the step of determining whether or not the temperatures detected by the temperature sensors 22*s* and 23*s* are the temperatures equal to or more than the melting point of the ink (Step S15).

In the case where it is determined that the head heating unit 24 is stopped in Step S18 (S18: Yes), then the temperature adjustment of the head heating unit 24 is resumed, and it is determined whether or not the temperature detected by the temperature sensor 24*s* is the temperature equal to or more than the melting point of the ink (Step S19).

Then, in the case where the control unit 8 has determined in Step S19 that the temperature detected by the temperature sensor 24*s* is the temperature equal to or more than the melting point of the ink (Step S19: Yes), then the control unit 8 determines that the current state is a state where it is possible to eject the ink from the head 10 in which the back pressure is controlled, drives the drive motor 4*m*, the head 10 and the like, and allows these to perform the formation of the image on the recording mediums.

(3) Supply Method of Ink in which there is Hysteresis in Phase Transition Temperature of Ink (No. 1)

Figure 7:
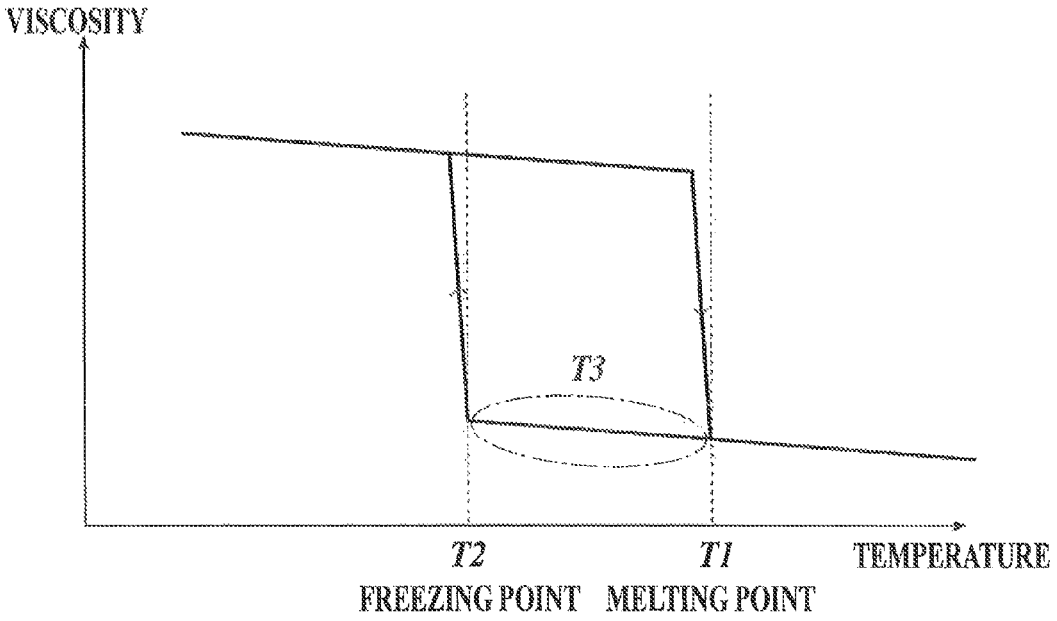
FIG. 7 is a graph showing properties of the ink in which there is a hysteresis in a phase transition temperature.

Next, a description is made of a supply method of the ink in the case where there is a hysteresis in a phase transition temperature of the ink (No. 1). Here, as shown in FIG. 7, the ink in which there is a hysteresis in the phase transition temperature refers to ink in which a temperature T1 (melting point) when the solid ink makes a phase transition to liquid and a temperature T2 (freezing point) when the liquid ink makes a phase transition to solid are different from each other.

Note that, with regard to the ink in this embodiment, the phase transition temperature thereof is preferably 40° C. or more to 150° C. or less, more preferably 45° C. or more to 130° C. or less. If the phase transition temperature of the ink is 40° C. or more, then an influence of a printing environment temperature is small in the event of injecting the ink droplets from the head, and stable injection characteristics can be obtained, and if the phase transition temperature of the ink is 150° C. or less, then it is not necessary to excessively heat the ink jet recording apparatus, and accordingly, loads on members of an ink supply system, such as the head and the ink flow passages can be reduced.

As specific ink, for example, it is preferable to use such inks as disclosed in Japanese Patent Application Laid-Open Publications Nos. 2006-193745, 2005-126507 and 2009-132919. Among them, as described in the example of Japanese Patent Application Laid-Open Publication No. 2005-126507, ink is more preferable, which at least contains an oil gelling agent and an active ray curable composition that cures by an active ray.

Figure 8:
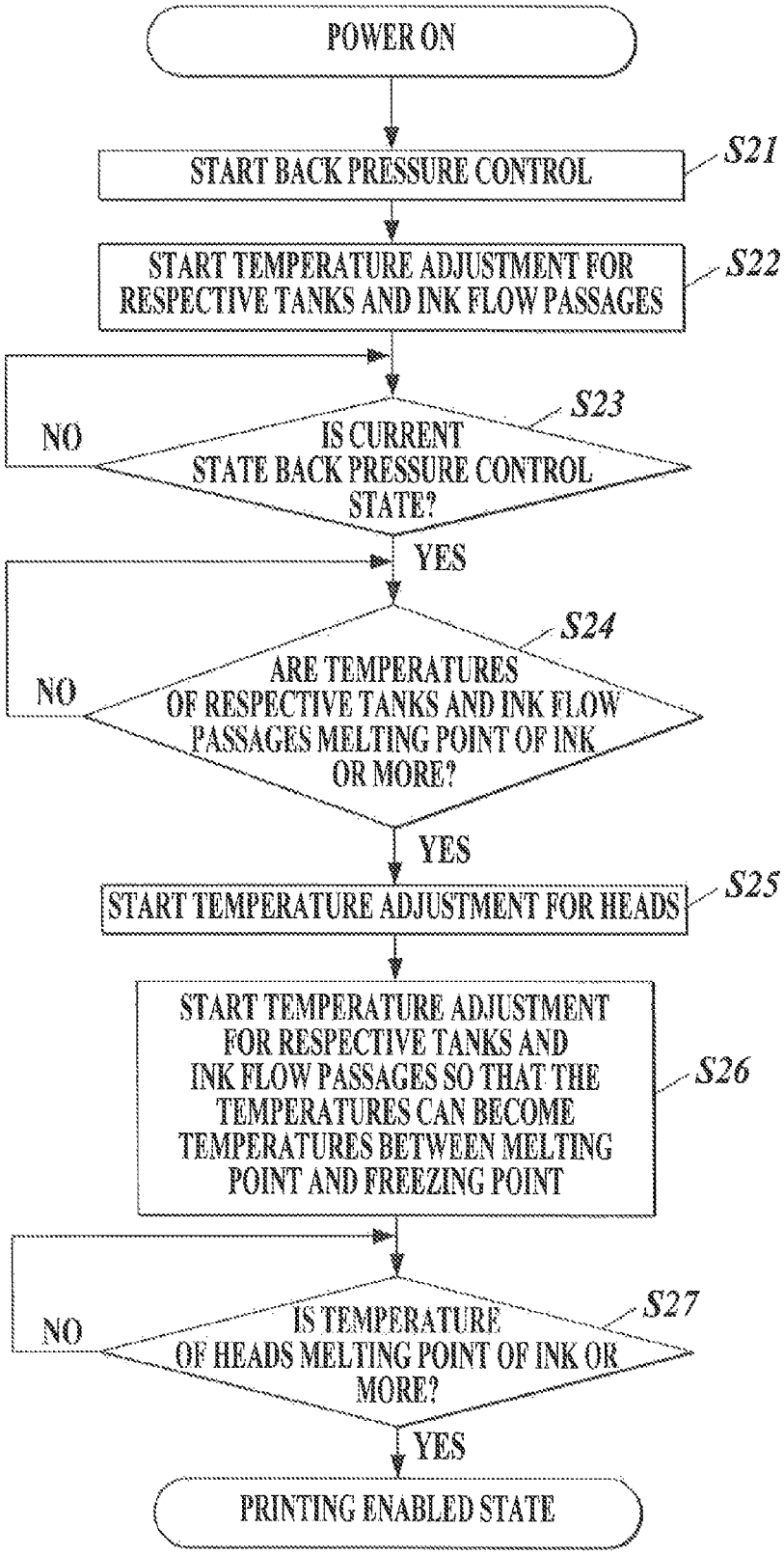
FIG. 8 is a flowchart showing a flow of an ink supply method (No. 1) at a time of using the ink in which there is a hysteresis in the phase transition temperature.

As shown in FIG. 8, when the power supply of the ink jet printer 100 is turned on, the control unit 8 controls the supply and exhaust of the air in the air chamber 15, which are to be performed by the compression vacuum pump 16, so that the air pressure in the air chamber 15, which is detected by the air pressure sensor 18, becomes a predetermined setting value set in advance (Step S21). In such a way, the back pressure control in the head 10 is performed.

Subsequently, the control unit 8 performs the temperature adjustment so that the main tank 11, the sub-tank 12 and the ink flow passages 13 and 20 can reach the temperature equal to or more than the melting point of the ink, that is, so that the ink in the insides of these becomes liquid from solid (Step S22).

That is to say, the control unit 8 adjusts the ink pressure in the main tank 11 and the sub-tank 12 to a predetermined pressure, and performs the temperature adjustment so that the ink in the ink flow passages 13 and 20 including these ink tanks can become liquid from solid.

In the temperature adjustment, the control unit 8 individually performs the heating for the respective units by the tank heating units 22 and the flow passage heating units 23 so that the temperatures to be detected by the temperature sensors 22*s* and 23*s* becomes the temperatures (to be set in advance) equal to or more than the melting point of the ink.

Subsequently, the control unit 8 determines whether or not the air pressure detected by the air pressure sensor 18 has become a setting value (Step S23).

In the case where the control unit 8 has determined in Step S23 that the air pressure has become the setting value (Step S23: Yes), the control unit 8 determines whether or not the temperatures detected by the temperature sensors 22*s* and 23*s* are the temperatures equal to or more than the melting point of the ink (Step S24).

In the case where the control unit 8 has determined in Step S24 that the temperatures detected by the temperature sensors 22*s* and 23*s* are the temperatures equal to or more than the melting point of the ink (Step S24: Yes), the control unit 8 performs the temperature adjustment so that the head 10 can reach the temperature equal to or more than the melting point of the ink, that is, so that the ink in the inside of the head 10 becomes liquid from solid (Step S25).

In the temperature adjustment, the control unit 8 individually performs the heating for the respective units by the head heating unit 24 so that the temperature to be detected by the temperature sensor 24*s* becomes the temperature (to be set in advance) equal to or more than the melting point of the ink.

Subsequently, the control unit 8 performs the temperature adjustment so that the temperatures of the main tank 11, the sub-tank 12 and the ink flow passages 13 and 20 becomes temperatures higher than the freezing point of the ink and lower than the melting point of the ink (Step S26). That is to say, the control unit 8 is a unit that achieves energy saving by lowering the respective temperatures of the main tank 11, the sub-tank 12 and the ink flow passages 13 and 20 to a temperature, at which the ink does not solidify, though while maintaining the ink thereof in a liquid state.

In the temperature adjustment, the control unit 8 individually performs the heating for the respective units by the tank heating units 22 and the flow passage heating units 23 so that the temperatures to be detected by the temperature sensors 22*s* and 23*s* becomes a temperature T3 (T2<T3<T1) higher than the freezing point T2 of the ink and lower than the melting point T1 of the ink.

Subsequently, the control unit 8 determines whether or not the temperature detected by the temperature sensor 24*s* is a temperature equal to or more than the melting point of the ink (Step S27).

Then, in the case where the control unit 8 has determined in Step S27 that the temperature detected by the temperature sensor 24*s* is the temperature equal to or more than the melting point of the ink (Step S27: Yes), the control unit 8 determines that the current state is a state where it is possible to eject the ink from the head 10 in which the back pressure is controlled, drives the drive motor 4*m*, the head 10 and the like, and allows these to perform the formation of the image on the recording mediums.

As described above, in the case where there is a hysteresis in the phase transition temperature of the ink, the control unit 8 first adjusts the ink pressures of the respective tanks 11 and 12, then adjusts the temperatures of the respective tanks 11 and 12 and the ink flow passages 13 and 20 to the temperature equal to or more than the melting point of the ink, and thereafter, adjusts the temperature of the head 10 to the temperature equal to or more than the melting point of the ink. In addition, the control unit 8 adjusts the temperatures of the respective tanks 11 and 12 and the ink flow passages 13 and 20 to the temperature higher than the freezing point of the ink and lower than the melting point of the ink. That is to say, the freezing point of the ink is lower than the melting point thereof, and accordingly, after the ink is once molten, the temperature of the ink is lowered to the temperature at which the ink can be kept liquid, whereby energy consumption of the respective heating units 22 and 23 can be reduced, and the energy saving can be achieved.

(4) Supply Method of Ink in which there is Hysteresis in Phase Transition Temperature (No. 2)

Next, a description is made of a supply method of the ink in the case where there is a hysteresis in the phase transition temperature (No. 2).

Figure 9:
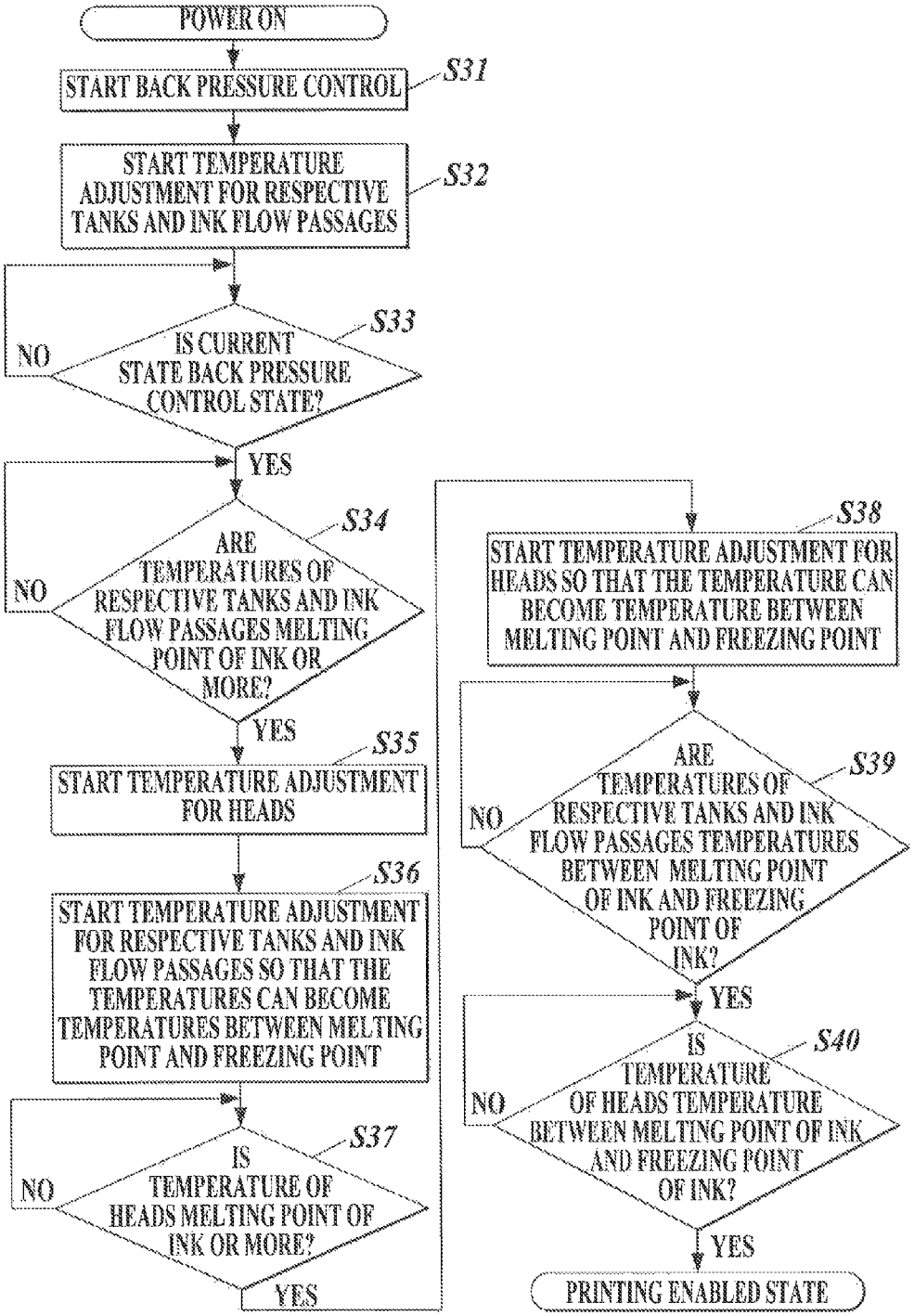
FIG. 9 is a flowchart showing a flow of an ink supply method (No. 2) at the time of using the ink in which there is a hysteresis in the phase transition temperature.

As shown in FIG. 9, when the power supply of the ink jet printer 100 is turned on, the control unit 8 controls the supply and exhaust of the air in the air chamber 15, which are to be performed by the compression vacuum pump 16, so that the air pressure in the air chamber 15, which is detected by the air pressure sensor 18, becomes a predetermined setting value set in advance (Step S31). In such a way, the back pressure control in the head 10 is performed.

Subsequently, the control unit 8 performs the temperature adjustment so that the main tank 11, the sub-tank 12 and the ink flow passages 13 and 20 can reach the temperature equal to or more than the melting point of the ink, that is, so that the ink in the insides of these becomes liquid from solid (Step S32).

That is to say, the control unit 8 adjusts the ink pressure in the main tank 11 and the sub-tank 12 to a predetermined pressure, and performs the temperature adjustment so that the ink in the ink flow passages 13 and 20 including these ink tanks becomes liquid from solid.

In the temperature adjustment, the control unit 8 individually performs the heating for the respective units by the tank heating units 22 and the flow passage heating units 23 so that the temperatures to be detected by the temperature sensors 22*s* and 23*s* becomes the temperatures (to be set in advance) equal to or more than the melting point of the ink.

Subsequently, the control unit 8 determines whether or not the air pressure detected by the air pressure sensor 18 has become a setting value (Step S33).

In the case where the control unit 8 has determined in Step S33 that the air pressure has become the setting value (Step S33: Yes), the control unit 8 determines whether or not the temperatures detected by the temperature sensors 22*s* and 23*s* are the temperatures equal to or more than the melting point of the ink (Step S34).

In the case where the control unit 8 has determined in Step S34 that the temperatures detected by the temperature sensors 22*s* and 23*s* are the temperatures equal to or more than the melting point of the ink (Step S34: Yes), the control unit 8 performs the temperature adjustment so that the head 10 can reach the temperature equal to or more than the melting point of the ink, that is, so that the ink in the inside of the head 10 becomes liquid from solid (Step S35).

In the temperature adjustment, the control unit 8 individually performs the heating for the respective units by the head heating unit 24 so that the temperature to be detected by the temperature sensor 24*s* becomes the temperature (to be set in advance) equal to or more than the melting point of the ink.

Subsequently, the control unit 8 performs the temperature adjustment so that the temperatures of the main tank 11, the sub-tank 12 and the ink flow passages 13 and 20 becomes temperatures higher than the freezing point of the ink and lower than the melting point of the ink (Step S36). That is to say, the control unit 8 is a unit that achieves energy saving by lowering the respective temperatures of the main tank 11, the sub-tank 12 and the ink flow passages 13 and 20 to a temperature, at which the ink does not solidify, though while maintaining the ink thereof in a liquid state.

In the temperature adjustment, the control unit 8 individually performs the heating for the respective units by the tank heating units 22 and the flow passage heating units 23 so that the temperatures to be detected by the temperature sensors 22*s* and 23*s* becomes the temperature T3 (T2<T3<T1) higher than the freezing point T2 of the ink and lower than the melting point T1 of the ink.

Subsequently, the control unit 8 determines whether or not the temperature detected by the temperature sensor 24*s* is a temperature equal to or more than the melting point of the ink (Step S37).

Subsequently, the control unit 8 performs the temperature adjustment so that the temperature of the head 10 becomes such a temperature higher than the freezing point of the ink and lower than the melting point of the ink (Step S28). That is to say, the control unit 8 is a unit that achieves energy saving by lowering the temperature of the head 10 to a temperature, at which the ink does not solidify, though while maintaining the ink thereof in a liquid state.

In the temperature adjustment, the control unit 8 individually performs the heating for each unit by the head heating unit 24 so that the temperature to be detected by the temperature sensor 24*s* becomes the temperature T3 (T2<T3<T1) higher than the freezing point T2 of the ink and lower than the melting point T1 of the ink.

Subsequently, the control unit 8 determines whether or not the temperatures detected by the temperature sensors 22*s* and 23*s* are the temperatures higher than the freezing point of the ink and lower than the melting point of the ink (Step S39).

In the case where the control unit 8 has determined in Step S39 that the temperatures detected by the temperature sensors 22*s* and 23*s* are the temperatures higher than the freezing point of the ink and lower than the melting point of the ink (Step S39: Yes), the control unit 8 determines whether or not the temperature detected by the temperature sensor 24*s* is the temperature higher than the freezing point of the ink and lower than the melting point of the ink (Step S40).

Then, in the case where the control unit 8 has determined in Step S40 that the temperature detected by the temperature sensor 24*s* is the temperature higher than the freezing point of the ink and lower than the melting point of the ink (Step S40: Yes), the control unit 8 determines that the current state is a state where it is possible to eject the ink from the head 10 in which the back pressure is controlled, drives the drive motor 4*m*, the head 10 and the like, and allows these to perform the formation of the image on the recording mediums.

As described above, the control unit 8 first adjusts the ink pressures of the respective tanks 11 and 12, then adjusts the temperature of the head 10 to the temperature higher than the freezing point of the ink and lower than the melting point of the ink. That is to say, the freezing point of the ink is lower than the melting point thereof, and accordingly, after the ink is once molten, the temperature of the ink is lowered to the temperature at which the ink can be kept liquid, whereby energy consumption of the head heating unit 24 can be reduced, and the energy saving can be achieved.

Note that, in this embodiment, the image forming is performed after passing through the determination steps of Steps S39 and S40; however, such a configuration is a control flow for realizing the printing under a stable head temperature, and is not an essential control flow for rapid image formation.

3. Power Shutdown Method

Next, a description is made of a power supply shutdown method in the ink jet printer 100.

(1) Usual Power Shutdown Method

Figure 10:
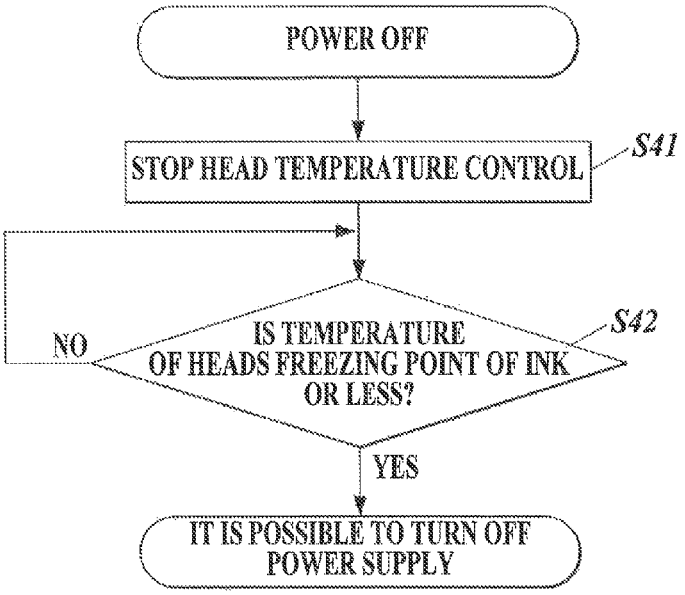
FIG. 10 is a flowchart showing a flow of a power shutdown method of an ink jet printer.

As shown in FIG. 10, when input to turn off the power supply of the ink jet printer 100 is made by the input operation unit 26, the control unit 8 stops such temperature control for the head 10 (Step S41). Specifically, the control unit 8 stops the energization to the head heating unit 24, and cools the head 10 by natural heat radiation.

Subsequently, the control unit 8 determines whether or not the temperature detected by the temperature sensor 24*s* is a temperature equal to or less than the freezing point of the ink (Step S42).

Then, in the case where the control unit 8 has determined in Step S42 that the temperature detected by the temperature sensor 24*s* is the temperature equal to or less than the freezing point of the ink (Step S42: Yes), the control unit 8 determines that the current state is a state where it is possible to turn off the power supply, and turns off the power supply of the ink jet printer 100.

As described above, the control unit 8 adjusts the temperature of the head 10 to the temperature equal to or lower than the freezing point of the ink, and solidifies the ink, and thereafter, the control unit 8 turns off the power supply, and accordingly, the ink leakage from the head 10 occurred due to not maintaining the pressure in the head 10, can be suppressed. Hence, the waste of the ink can be eliminated, and the maintenance labor for the nozzles of the head 10 can be reduced.

Figure 11:
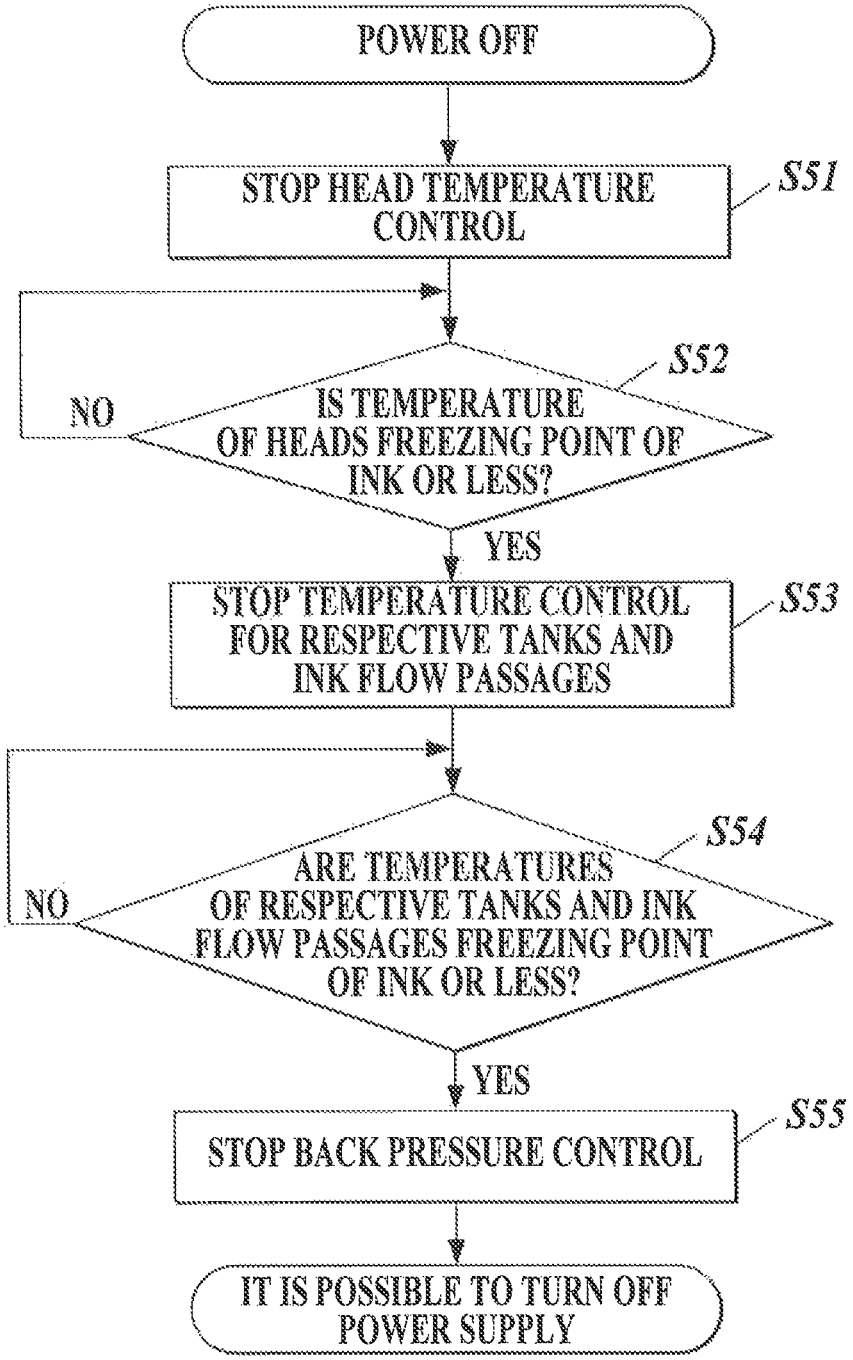
FIG. 11 is a flowchart showing a flow of a power shutdown method of the ink jet printer in a case of performing back pressure control until the ink of the respective units solidifies.

(2) Power Shutdown Method in Case of Performing Back Pressure Control Until Ink of Respective Units Solidifies As shown in FIG. 11, when the input to turn off the power supply of the ink jet printer 100 is made by the input operation unit 26, the control unit 8 stops the temperature control for the head 10 (Step S51). Specifically, the control unit 8 stops the energization to the head heating unit 24, and cools the head 10 by the natural heat radiation.

Subsequently, the control unit 8 determines whether or not the temperature detected by the temperature sensor 24*s* is the temperature equal to or less than the freezing point of the ink (Step S52).

In the case where the control unit 8 has determined in Step S52 that the temperature detected by the temperature sensor 24*s* is the temperature equal to or less than the freezing point of the ink (Step S52: Yes), the control unit 8 stops the temperature control for the respective tanks 11 and 12 and ink flow passages 13 and 20 (Step S53). Specifically, the control unit 8 stops the energization to the tank heating units 22 and flow passage heating units 23, and cools the respective tanks 11 and 12 and ink flow passages 13 and 20 by the natural heat radiation.

Subsequently, the control unit 8 determines whether or not the temperatures detected by the temperature sensors 22*s* and 23*s* are the temperatures equal to or less than the freezing point of the ink (Step S54).

In the case of having determined in Step S54 that the temperatures detected by the temperature sensors 22*s* and 23*s* are the temperatures equal to or less than the freezing point of the ink (Step S54: Yes), the control unit 8 stops the back pressure control for the inside of the head 10 (Step S55).

Then, the control unit 8 turns off the power supply of the ink jet printer 100.

As described above, the control unit 8 adjusts the temperature of the head 10 to the temperature equal to or less than the freezing point of the ink, and solidifies the ink, thereafter, adjusts the temperatures of the respective tanks 11 and 12 and ink flow passages 13 and 20 to the temperature equal to or less than the freezing point of the ink, and solidifies the ink, and thereafter, turns off the power supply. In such a way, such a phenomenon can be suppressed that the air is inhaled into the head 10 by generation of a negative pressure in the head 10, which is caused by the fact that a volume of the air in the head 10 is decreased as a result that the ink located on the upstream of the head 10 is first cooled and the air in the head 10 is cooled. Hence, the maintenance labor for the nozzles of the head 10 can be reduced.

Moreover, the control unit 8 adjusts the pressure, which is to be applied to the ink in the head 10, until the temperature of the head 10 becomes the freezing point of the ink or less, and accordingly, the negative pressure in the head 10 can be maintained until the ink of the head 10 solidifies, and the ink can be suppressed from leaking from the head 10.

That is to say, if the control for the back pressure is ended before the ink solidifies, then the pressure is applied to the solid ink of the head 10 owing to a water head difference. When the pressure is applied to the solid ink, the solid ink concerned turns to such a state of being extruded from the nozzles. Accordingly, the back pressure control is performed until the ink in the head 10, the tanks 11 and 12 and the ink flow passages 13 and 20 entirely solidifies, whereby such a problem as described above can be solved.

Hence, the waste of the ink can be eliminated, and the maintenance labor for the nozzles of the head 10 can be reduced.

As in FIG. 11, in the case where such a request to turn off the power supply is inputted, the head temperature adjustment is stopped, and it is confirmed that the head temperature becomes the temperature at which the ink in the head concerned solidifies, and thereafter, the temperature adjustment for the flow passage portions is sequentially performed. However, in place of the above, as in FIG. 12, in a similar way to the time when the power supply is turned on in FIG. 6, a configuration may be adopted, in which the temperature adjustment for the head and the temperature adjustment for the flow passage portions are simultaneously controlled, and the head temperature is controlled to become lower than the temperatures of the flow passage portions.

Figure 12:
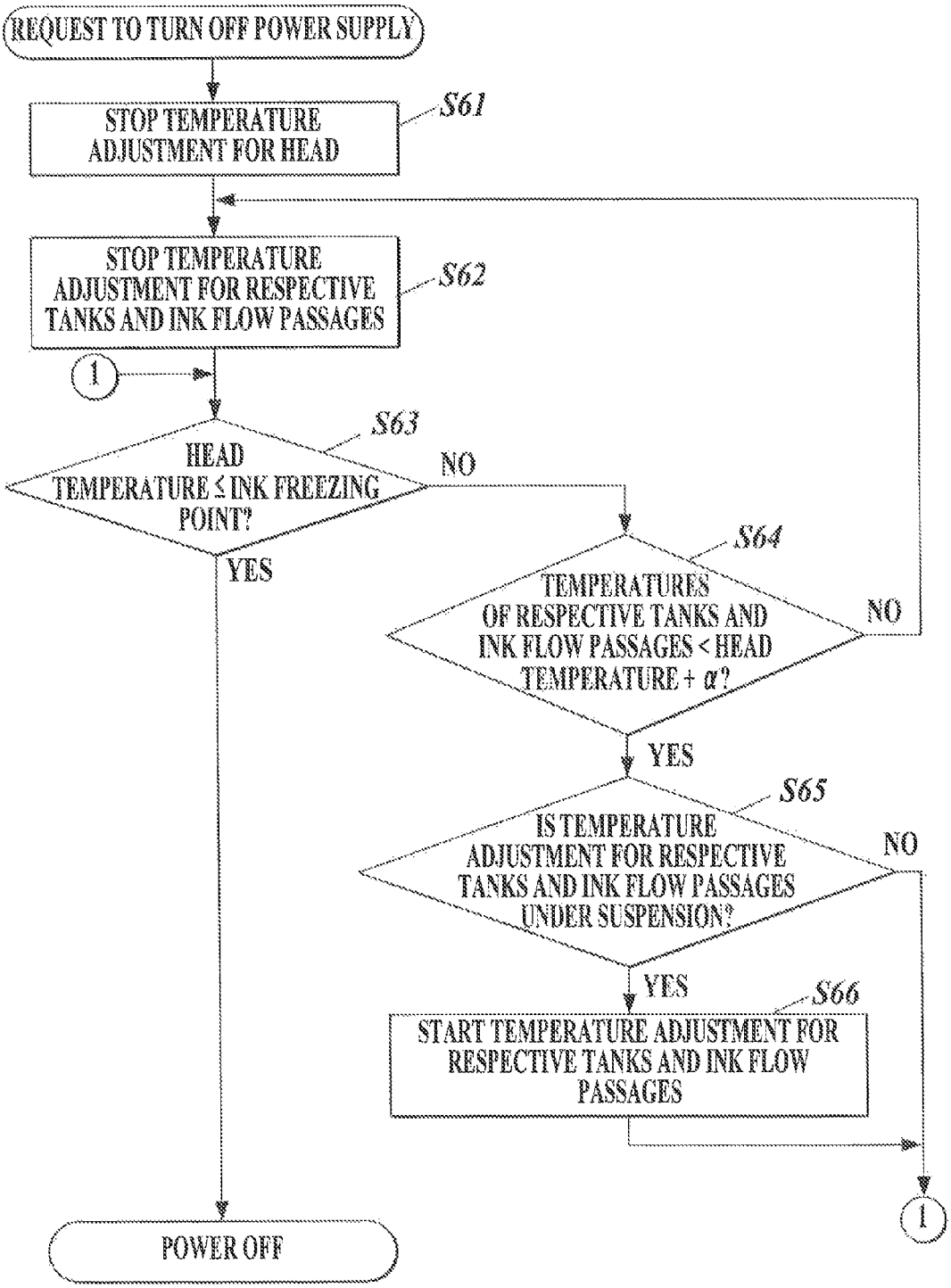
FIG. 12 is a flowchart showing a flow of a power shutdown method of the ink jet printer, which is different from that of FIG. 11.

That is to say, in FIG. 12, when the input to turn off the power supply of the ink jet printer 100 is made by the input operation unit 26, the control unit 8 stops the temperature control for the head 10 (Step S61). Specifically, the control unit 8 stops the energization to the head heating unit 24, and cools the head 10 by the natural heat radiation.

Subsequently, the control unit 8 stops the temperature control for the respective tanks 11 and 12 and ink flow passages 13 and 20 (Step S62). Specifically, the control unit 8 stops the energization to the tank heating units 22 and the flow passage heating units 23, and cools the respective tanks 11 and 12 and ink flow passages 13 and 20 by the natural heat radiation.

In Step S63, the control unit 8 determines whether or not the temperature detected by the temperature sensor 24*s* is the temperature equal to or less than the freezing point of the ink in the head (Step S63).

In the case where the control unit 8 has determined in Step S63 that the temperature detected by the temperature sensor 24*s* is the temperature equal to or less than the freezing point of the ink in the head (Step S63: Yes), the control unit 8 turns off the power supply.

Moreover, in the case where the control unit 8 has determined in Step S63 that the temperature detected by the temperature sensor 24*s* is the temperature higher than the freezing point of the ink (Step S63: No), the control unit 8 determines whether or not the temperatures of the respective tanks 11 and 12 and ink flow passages 13 and 20 are lower than the substantial head temperature in which the amount of margin a such as a measurement error and temperature irregularity is added to the temperature of the head (Step S64).

In the case where it is determined in Step S64 that the temperatures of the respective tanks and ink flow passages are lower than the substantial head temperature (Step S64: Yes), then it is determined in Step S65 whether or not the temperature control for the respective tanks and ink flow passages is stopped (Step S65).

In the case where it is determined that the temperature control is stopped in Step S65 (Step S65: Yes), then the temperature control for the respective tanks 11 and 12 and ink flow passages 13 and 20 is started (Step S66). Meanwhile, in the case where it is determined that the temperature control is not stopped (Step S65: No), the method returns to Step S63, and the determination step concerned is performed one more time.

Moreover, in the case where it is determined in Step S64 that the temperatures of the respective tanks and ink flow passages are higher than the head temperature (Step S64: No), then the temperature control for the respective tanks 11 and 12 and ink flow passages 13 and 20 is stopped one more time. In such a way, the temperature control for the flow passage portions is implemented while monitoring the temperatures of the head portion and the flow passage portions so that the temperature of the head portion does not exceed the temperatures of the flow passage portions, whereby the ink in the head can be solidified prior to the ink in the flow passage portions rapidly and accurately.

That is to say, the temperature adjustment for the head and the temperature adjustment for the flow passage portions are controlled simultaneously, whereby it is made possible to control to turn off the power supply more rapidly and highly reliably in comparison with a configuration of performing the temperature control sequentially for these.

4. Modification Example

Note that the present invention is not limited to the above-described embodiment, and a design thereof is freely changeable within the scope without changing the essential portions of the invention.

In the above-described embodiment, the ink supply device performs the back pressure control for the head by using the air pressure; however, as mentioned at the beginning, this may be replaced by a configuration of performing the back pressure control for the head by using the water head difference between the nozzle surface and the liquid level of the tank.

Figure 13:
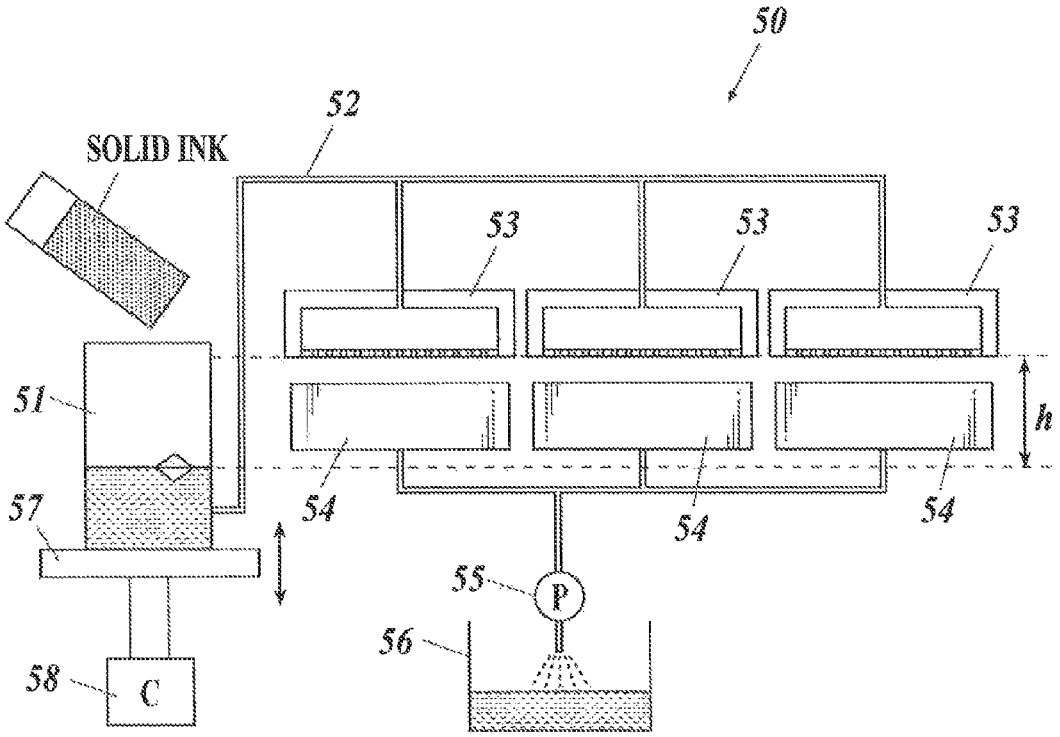
FIG. 13 is a schematic view of an ink supply device that performs back pressure adjustment for heads by a water head difference.

Specifically, as shown in FIG. 13, in a water head-type ink supply device 50, heads 53 are connected to a tank 51 through an ink flow passage 52. Below the respective heads 53, ink pans 54, which receive drained ink drained from nozzle surfaces of the heads 53, are provided, and ink accumulated in the ink pans 54 is sucked by a pump 55, and is discharged to a drained ink tank 56.

It is made possible to throw solid ink into the tank 51, and in a similar way to the above-described embodiment, the solid ink in the tank 51 is heated and molten by a tank heating unit.

The tank 51 is attached onto a support base 57, and the support base 57 is made freely movable in a vertical direction by an air cylinder 58. That is to say, the air cylinder 58 functions as a vertical motion mechanism.

Then, from a detection value of a liquid level detection unit (not shown) that detects a liquid level of the ink in the tank 51, based on a relative height thereof with the nozzle surfaces of the heads 53, the air cylinder 58 is driven by a control unit (liquid level control unit) in order to adjust a tank inside pressure, whereby the support base 57 moves in the vertical direction. Then, the tank 51 is also moved in the vertical direction. In such a way, a water head difference h between the nozzle surfaces of the heads 53 and the liquid level of the tank 51 is adjusted, whereby the backpressure control for the heads 53 can be performed with ease at low cost.

Moreover, a configuration may be adopted, in which the support base 57 is not moved vertically, but the back pressure is controlled by a liquid level control unit, which controls the supply of the ink into the tank 51 so as to adjust a height of the ink liquid level in the tank, and thereby controls the liquid level.

Figure 14:
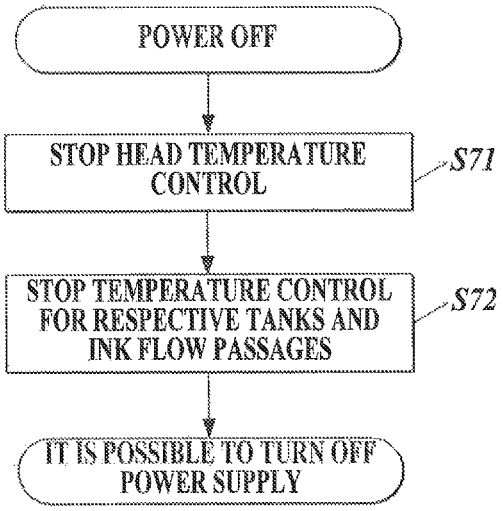
FIG. 14 is a flowchart showing a power shutdown method of an ink jet printer including the ink supply device that performs the back pressure adjustment for the heads by the water head difference.

In a power supply shutdown method in this case, as shown in FIG. 14, when input to turn off a power supply of an ink jet printer is made by an operation input unit, the control unit stops temperature control for the heads 53 (Step S71). Specifically, the control unit stops energization to a head heating unit, and cools the heads 53 by the natural heat radiation.

Subsequently, the control unit stops the temperature control for the tanks 51 and the ink flow passages 52 (Step S72). Specifically, the control unit stops the energization to the tank heating units and the flow passage heating units, and cools the tank 51 and the ink flow passage 52 by the natural heat radiation.

In such a way, the energization to all the heating units is stopped, and accordingly, the control unit determines that the current state is a state where it is possible to turn off the power supply, and turns off the power supply of the inkjet printer.

Note that such a control flow to the step of turning off the power supply in the event of the above-mentioned power supply shutdown method is also applicable similarly to a power saving mode input unit that manually or automatically inputs a turning-off instruction for temperature adjustment of a tank heating unit, a flow passage heating unit and a head heating unit.

That is to say, when the turning-off instruction for the temperature adjustment control for the tank heating unit, the flow passage heating unit and the head heating unit is manually or automatically inputted to the power saving mode input unit, the control unit 8 determines whether or not the temperature detected by the temperature sensor 24*s* is the temperature equal to or less than the freezing point of the ink. In the case where the control unit 8 has determined that the temperature detected by the temperature sensor 24*s* is equal to or less than the freezing point of the ink, the control unit 8 determines that the current state is a state where it is possible to stop the temperature adjustment control concerned, and turns off the temperature adjustment control for the head heating unit concerned.

In a similar way, the specific control flow shown in the above-mentioned "(2) Power shutdown method in case of performing back pressure control until ink of respective units solidifies" is also applicable as a "method for shutting down temperature adjustment for a tank heating unit, a flow passage heating unit and a head heating unit in case of performing back pressure control until ink solidifies" in a replacement manner.

Second Embodiment

As mentioned above, this embodiment relates to the configuration of controlling the water head value difference between the ink liquid level of the nozzle insides of the ink jet head and the liquid level of the ink in the ink storage unit by the back pressure control device. A description is made of a technology for suppressing the ink from being consumed wastefully by, even if the back pressure control device is stopped or put on standby, preventing such a phenomenon that the ink is extruded from the nozzles since the back pressure of the meniscus becomes larger than the atmospheric pressure.

Figure 15:
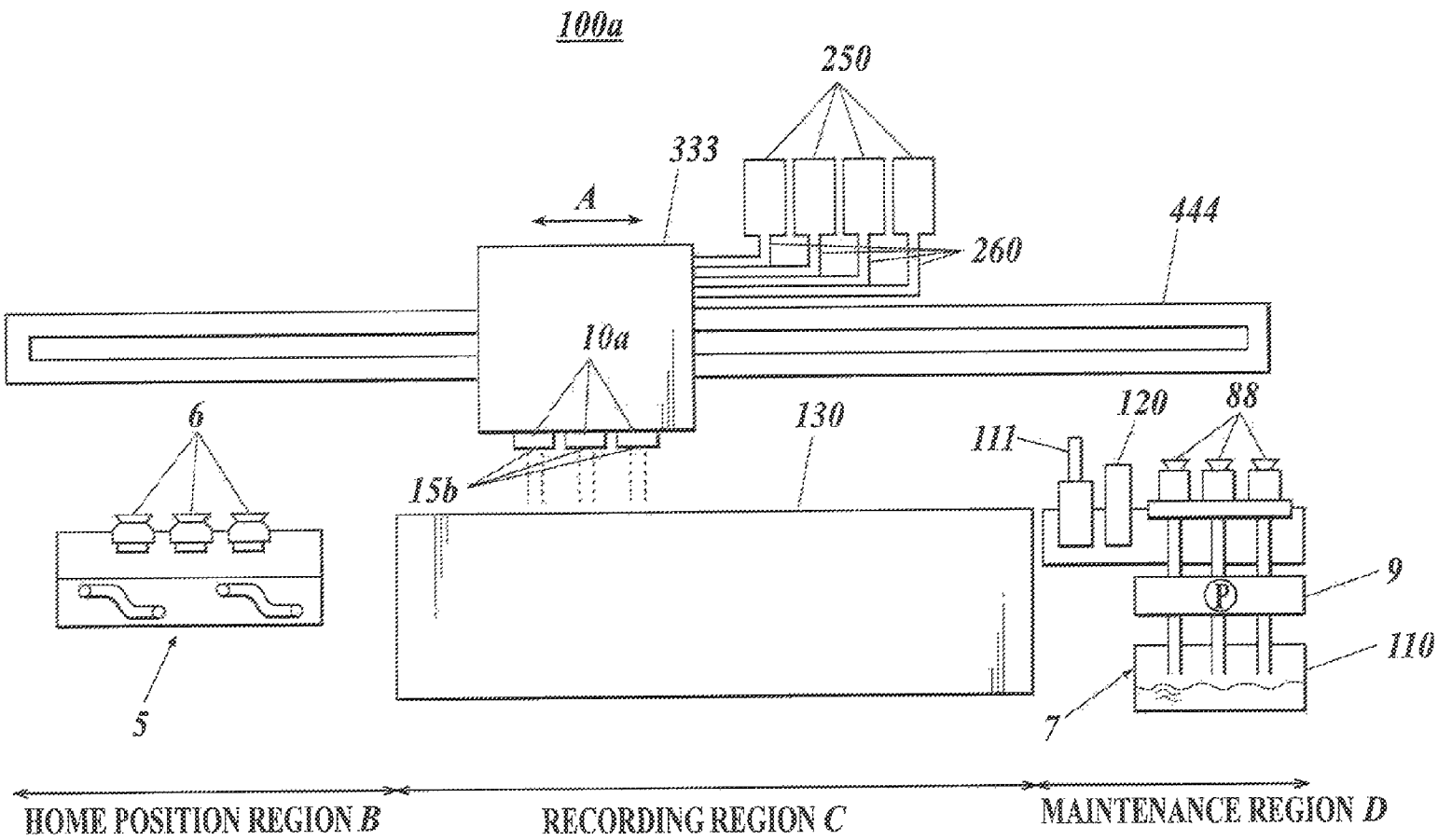
FIG. 15 is an explanatory view showing an overall configuration of an ink jet recording apparatus according to a second embodiment.

FIG. 15 is an overall configuration view of an ink jet recording apparatus of the second embodiment of the present invention. As shown in FIG. 15, an ink jet recording apparatus (ink jet printer) 100*a* is configured to include ink jet heads (hereinafter, simply referred to as "heads") 10*a*, a carriage 333, a carriage rail 444, a moisture retention unit 5, a maintenance unit 7, ink tanks 250, ink flow passages 260, and a control unit 30 (refer to FIG. 22).

A recording medium 130 on which an image is formed by the ink jet recording apparatus 100*a* is conveyed in a sub-scanning direction, which is perpendicular to a main scanning direction A in FIG. 15, so as to pass through a recording region C in FIG. 15. The conveyance of the recording medium 130 is performed by conveying means (not shown).

The carriage 333 mounts the heads 10*a* thereon, and moves in the direction of an arrow A along the carriage rail 444 from a home position region B to a maintenance region D. In the recording region C, main scanning on the recording medium 130 is performed by an operation of the carriage 333.

The heads 10*a* eject inks toward the recording medium 130 during this main scanning, and thereby form an image on the recording medium 130. There are a case of vertically placing the heads 10*a* so that a nozzle ejection direction becomes vertically downward, and a case of horizontally placing the heads 10*a* so that the nozzle ejection direction becomes a horizontal direction; however, it is possible to implement such placement in other directions. In any of the cases, the heads 10*a* are placed so that nozzle surfaces 15*b*, on which ejection ports of nozzles 152 (refer to FIG. 21) for ejecting the inks are arrayed, can be opposite to the recording medium 130.

In the inkjet recording apparatus 100*a* according to this embodiment, the heads 10*a*, of which number is four in total, are placed on the carriage 333 so as to be capable of ejecting the inks of four colors, which are black (K), yellow (Y), magenta (M) and cyan (C). Another head 10*a* is arranged on a depth side of the head 10*a* illustrated at the center.

The ink tanks 250 are ink storage units which store the inks to be supplied to the heads 10*a*. The ink tanks 250 are, for example, formed of ceramics and the like, and one thereof is placed for one head 10*a*. The ink flow passages 260 are placed in a form of allowing the heads 10*a* and the ink tanks 250 to communicate with each other, and guide the inks from the ink tanks 250 to the heads 10*a*.

Figure 16:
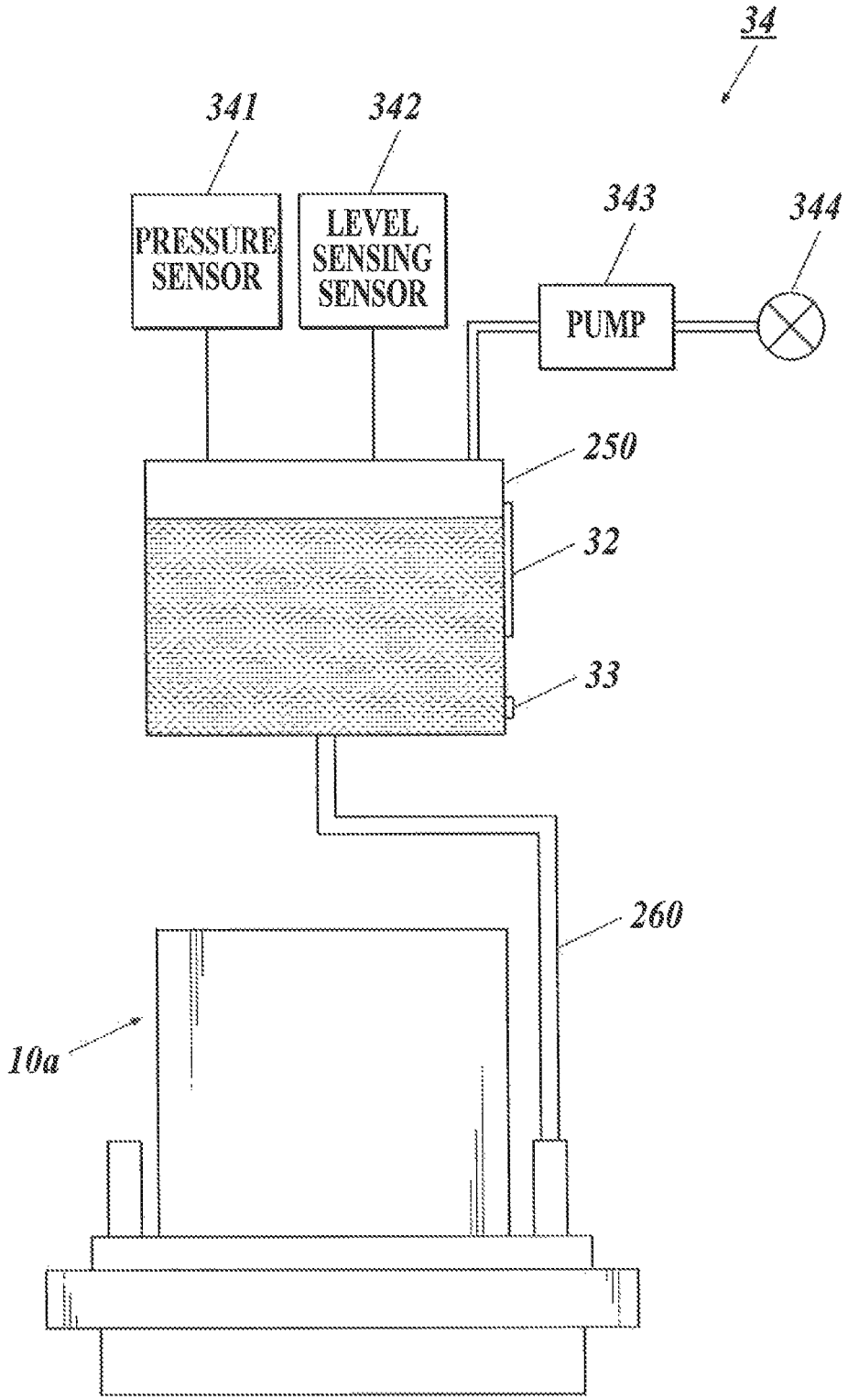
FIG. 16 is a schematic view showing a positional relationship between an ink tank and an ink jet head, which are provided in the ink jet recording apparatus of FIG. 15.

FIG. 16 is a schematic view showing a relationship between each of the ink tanks 250 and each of the head 10*a*. As shown in FIG. 16, the ink flow passage 260 is connected to a lower end surface of the ink tank 250. Moreover, on one side surface of the ink tank 250, there are provided: a second heater unit 32 as second heating means for heating the ink in the ink tank 250; and a second temperature sensor 33 for detecting a temperature of the ink in the ink tank 250.

Moreover, for the ink tank 250, a back pressure control unit 34 is provided, which serves as a reservoir unit pressure adjustment unit that controls a back pressure of a meniscus in the nozzles 152 of the heads 10*a*. This back pressure control unit 34 includes: a pressure sensor 341 that detects pressure in the ink tank 250; a level sensing sensor 342 that detects an amount of the ink in the ink tank 250; a pump 343 for adjusting an internal pressure of the ink tank 250; and a valve 344 that opens and closes communication between the pump 343 and external air.

As shown in FIG. 15, the maintenance unit 7 is arranged in the maintenance region D, and is configured to include suction caps 88, a cleaning blade 111, an ink receiver 120, a suction pump 9, a discarded ink tank 110, and the like. By a series of maintenance operations, the maintenance unit 7 removes foreign objects in the heads 10*a*, and recovers an ink ejection state of the heads 10*a* to a satisfactory state.

The suction caps 88 communicate with the discarded ink tank 110 through the suction pump 9, and at the time of the maintenance operations, ascend and cover the nozzle surfaces 15*b* of the heads 10*a*. Four suction caps 88 are provided. In order that the suction caps 88 can cover the nozzle surfaces 15*b*, 15*b* . . . of all the heads 10*a* at the time of ascending as mentioned above, the suction caps 88 are arrayed so as to correspond to an array of the heads 10*a* on the carriage 333.

The suction pump 9 is configured to include a cylinder pump or a tube pump. The suction pump 9 operates in a state where the suction caps 88 cover the nozzle surfaces 15*b*, and thereby generates a suction force for sucking the inks in the insides of the heads 10*a* together with the foreign objects from the ejection ports.

After the inks of the heads 10*a* are sucked, the cleaning blade 111 removes the inks adhered to the nozzle surfaces 15*b*. Thereafter, the ink receiver 120 receives inks ejected preliminarily by the heads 10*a*. The discarded ink tank 110 reserves the inks sucked from the heads 10*a* by the operation of the suction pump 9, and the ink ejected preliminarily from the heads 10*a*.

The moisture retention unit 5 is arranged in the home position region B, and is configured to include moisture retention caps 6. When the heads 10 are on a standby state, the moisture retention caps 6 cover the nozzle surfaces 15*b*, and thereby retain moisture of the inks of the heads 10*a*. Four moisture retention caps 6 are provided. In order that these four moisture retention caps 6 can simultaneously cover the nozzle surfaces 15*b* of the four heads 10*a*, the moisture retention caps 6 are arrayed so as to correspond to the array of the heads 10*a*.

Figure 17:
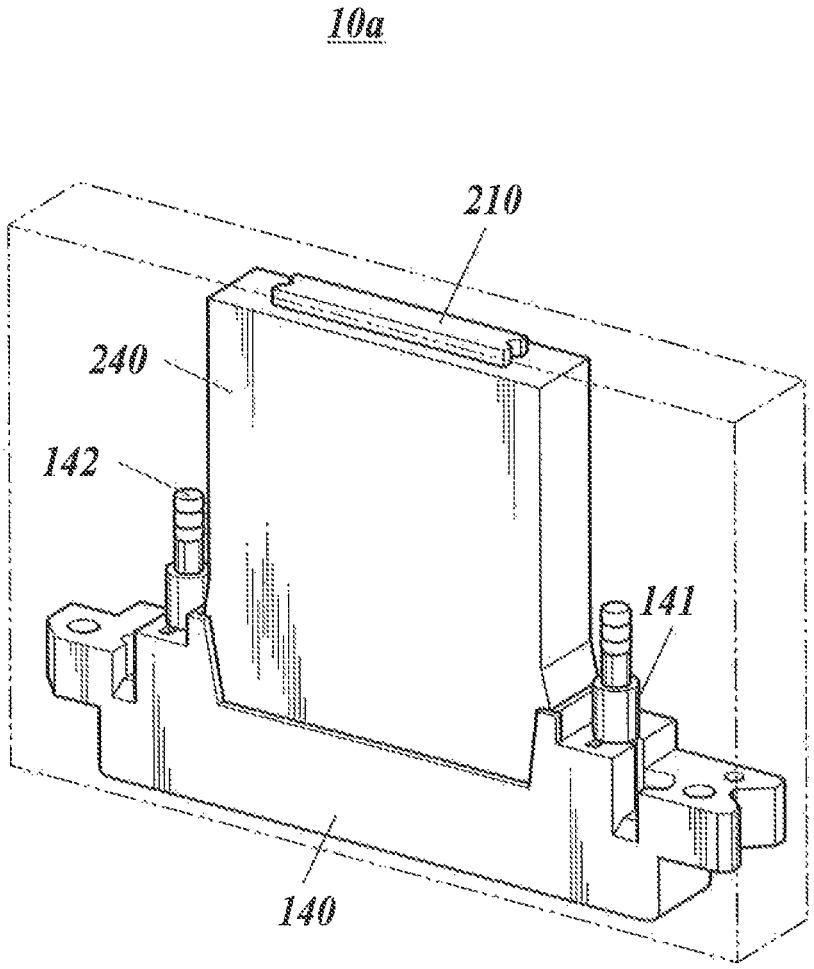
FIG. 17 is a perspective view showing an overall configuration of the ink jet head provided in the ink jet recording apparatus of FIG. 15.
Figure 18:
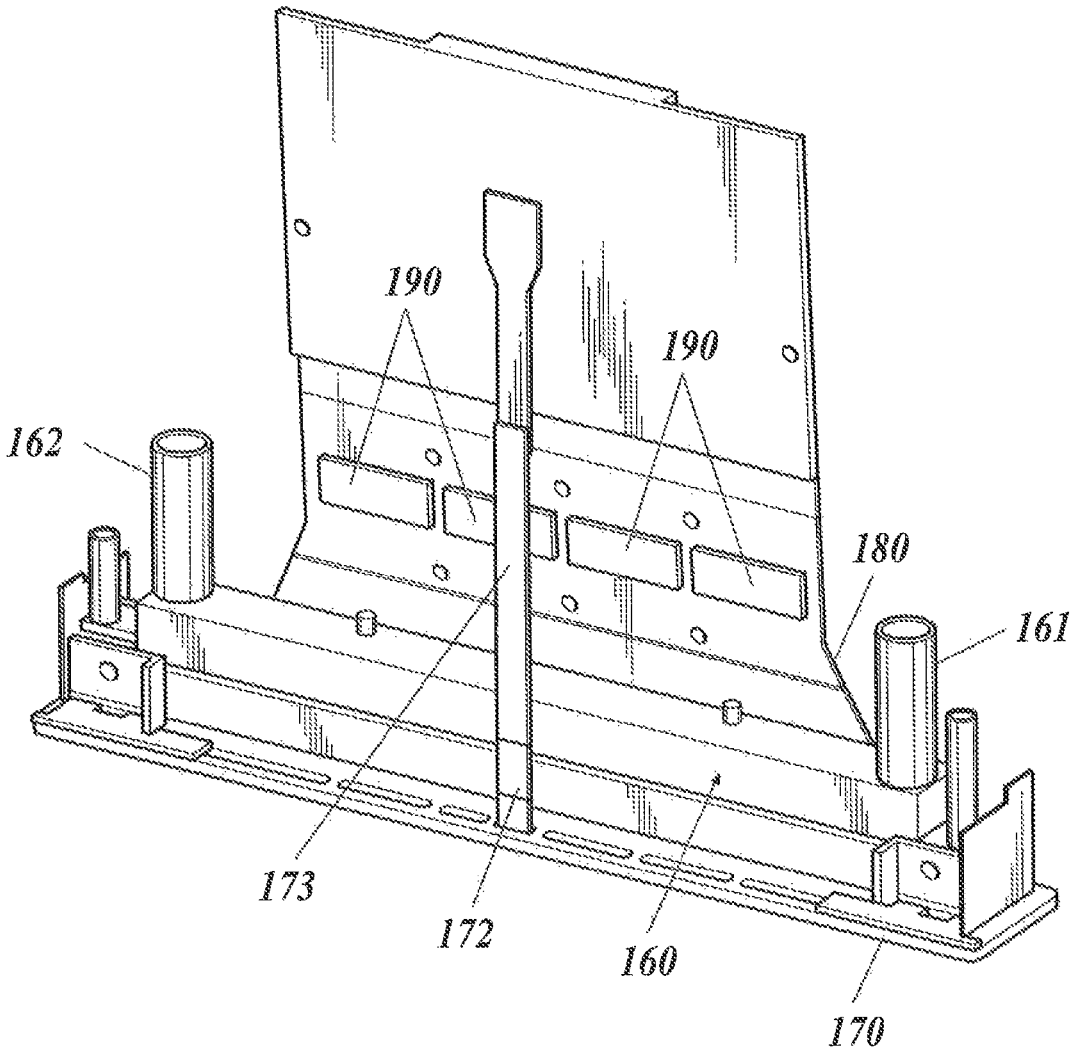
FIG. 18 is a perspective view showing a main portion configuration of the ink jet head of FIG. 16.
Figure 19:
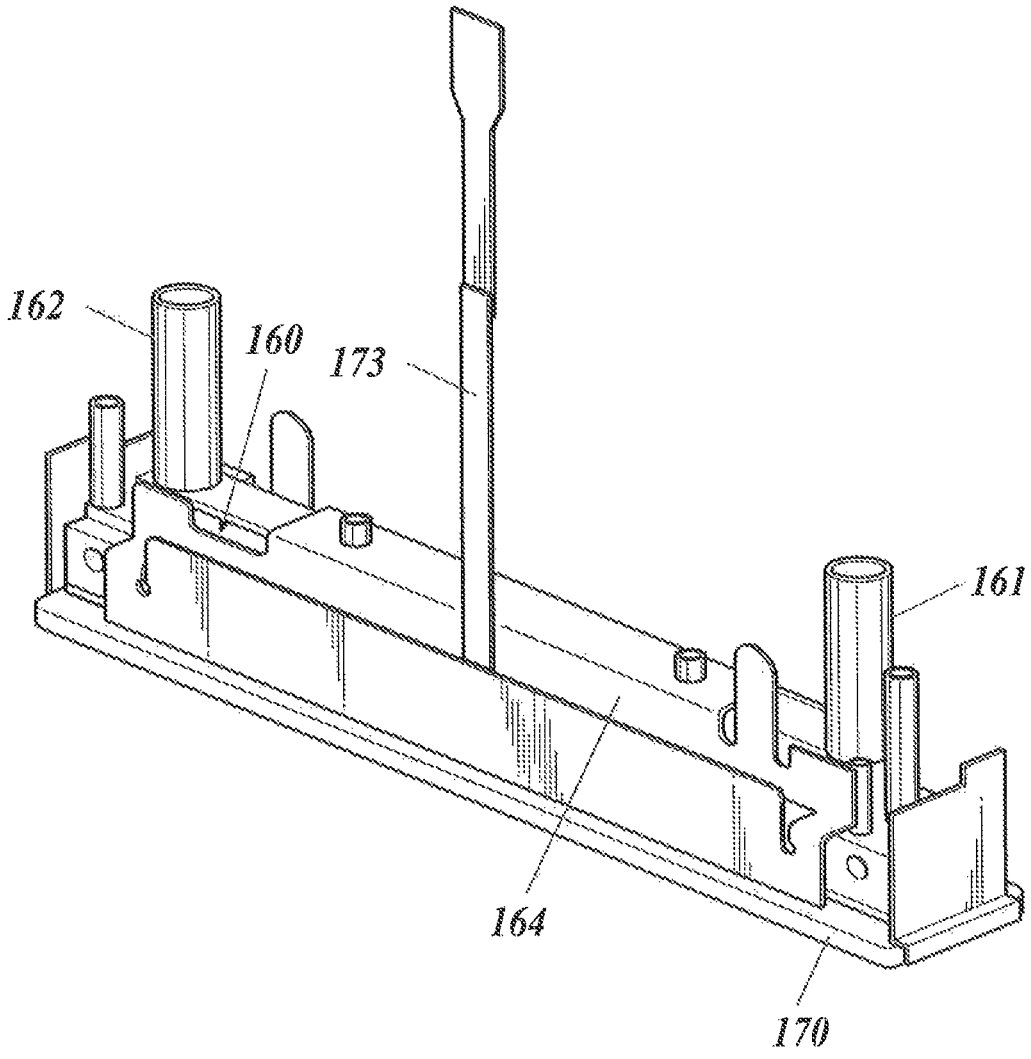
FIG. 19 is a perspective view showing a part of the ink jet head of FIG. 17.
Figure 20:
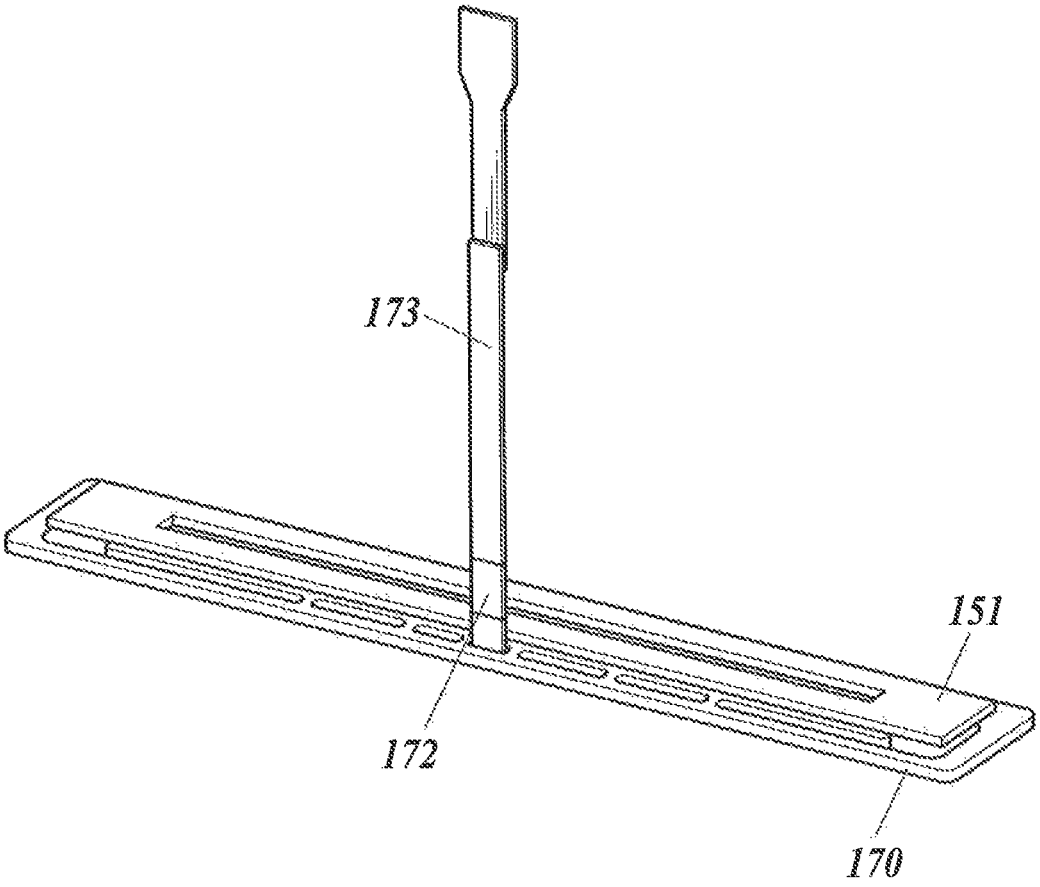
FIG. 20 is a perspective view showing a part of the ink jet head of FIG. 17.
Figure 21:
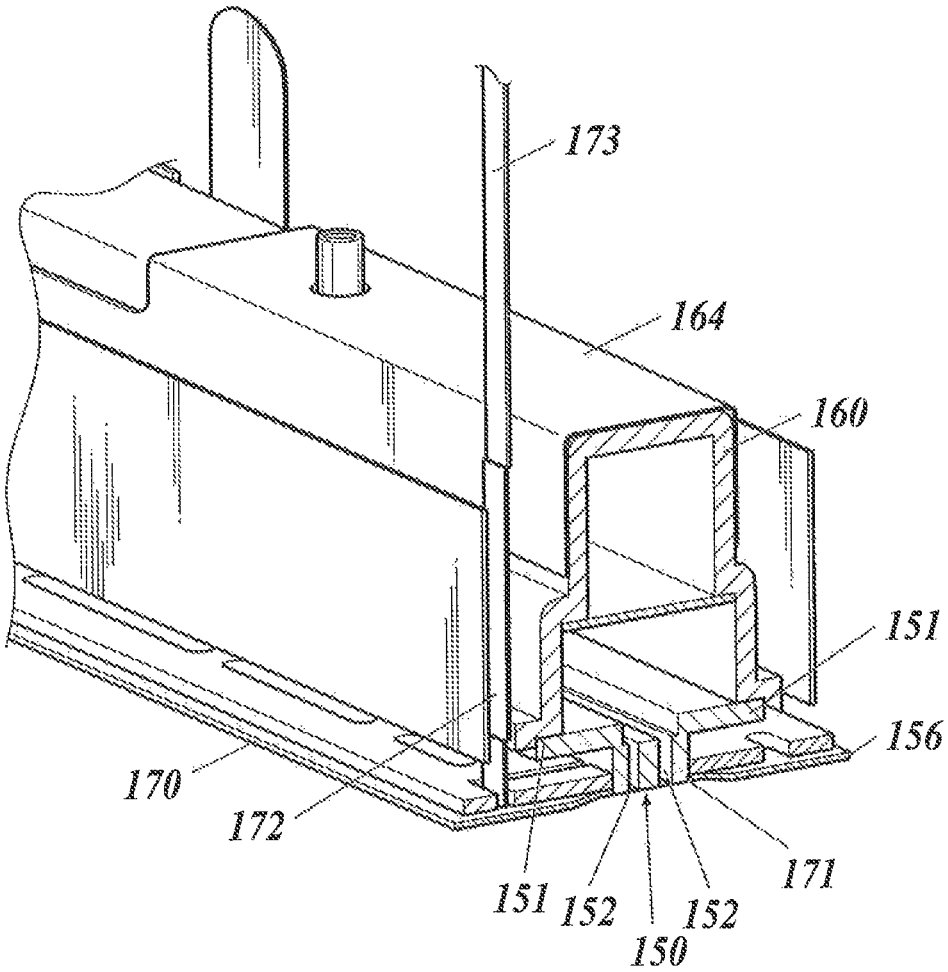
FIG. 21 is a perspective view where a part of the inkjet head of FIG. 17 is cut away in order to show an internal configuration of the ink jet head.

Next, a description is made of each of the heads 10*a*. FIG. 17 is a perspective view showing an overall configuration of the head 10*a*, FIG. 18 is a perspective view showing a main portion configuration of the head 10*a*, each of FIG. 19 and FIG. 20 is a perspective view showing a part of the head 10*a*, and FIG. 21 is a perspective view where a part of the head 10*a* is cut away in order to show an internal configuration of the head 10*a*. As shown in FIG. 17 to FIG. 21, in the head 10*a*, there are provided a cabinet frame 140, an ink jet head chip (hereinafter, simply referred to as a "head chip") 150, a manifold 160, a top plate 170, a flexible wiring board 180, a drive circuit board 190, an external connector 210, and a cover 240.

The cabinet frame 140 supports the head chip 150, the manifold 160, the top plate 170, the flexible wiring board 180, the drive circuit board 190 and the external connector 210. Then, the cover 240 is attached to the cabinet frame 140 so as to surround these. The external connector 210 is exposed from an upper portion of the cover 240. Moreover, on one end portion of the cabinet frame 140, a supply-use connection portion 141, to which the ink flow passage 260 is to be connected, is provided, and on another end portion thereof, a drainage-use connection portion 142, to which an ink drainage-use flow passage (not shown) is to be connected, is provided.

The manifold 160 supplies the head chip 150 with the ink that has flown thereinto from the ink flow passage 260. On an internal bottom portion of the manifold 160, the head chip 150 is arranged along a longitudinal direction thereof. Though the bottom portion of the manifold 160 is open, a wiring board 151 of the head chip 150 is attached so as to close such an opening. Moreover, onto one side surface of the manifold 160, the flexible wiring board 180 is attached, and this flexible wiring board 180 is electrically connected to the wiring board 151 of the head chip 150. On one end portion of the manifold 160, an introduction-use ink port 161 that communicates with the supply-use connection portion 141 is formed, and on another end portion thereof, a drainage-use ink port 162 that communicates with the drainage-use connection portion 142 is formed. Moreover, on a bottom surface of the wiring board 151, the top plate 170 that forms the nozzle surface 15*b* of the head 10*a* is stacked. The top plate 170 is formed of a raw material (for example, aluminum and the like) higher in thermal conductivity than at least either one of the ink tank 250 and the ink flow passage 260. On the top plate 170, slits 171 for exposing the respective nozzles 152 of the head chip 150 are formed. The ink ejected from the nozzles 152 of the head chip 150 is ejected to the outside through the slits 171 of the top plate 170. A first temperature sensor 172 is attached to the top plate 170. This first temperature sensor 172 is a sensor to detect a temperature of the ink in the head 10*a*. The flexible wiring board 173 is connected to the first temperature sensor 172, and is made capable of outputting a detection signal thereof to the outside. Moreover, on the periphery of the manifold 160, a first heater unit 164 is arranged, which serves as first heating means for heating the ink in the head 10*a*.

Figure 22:
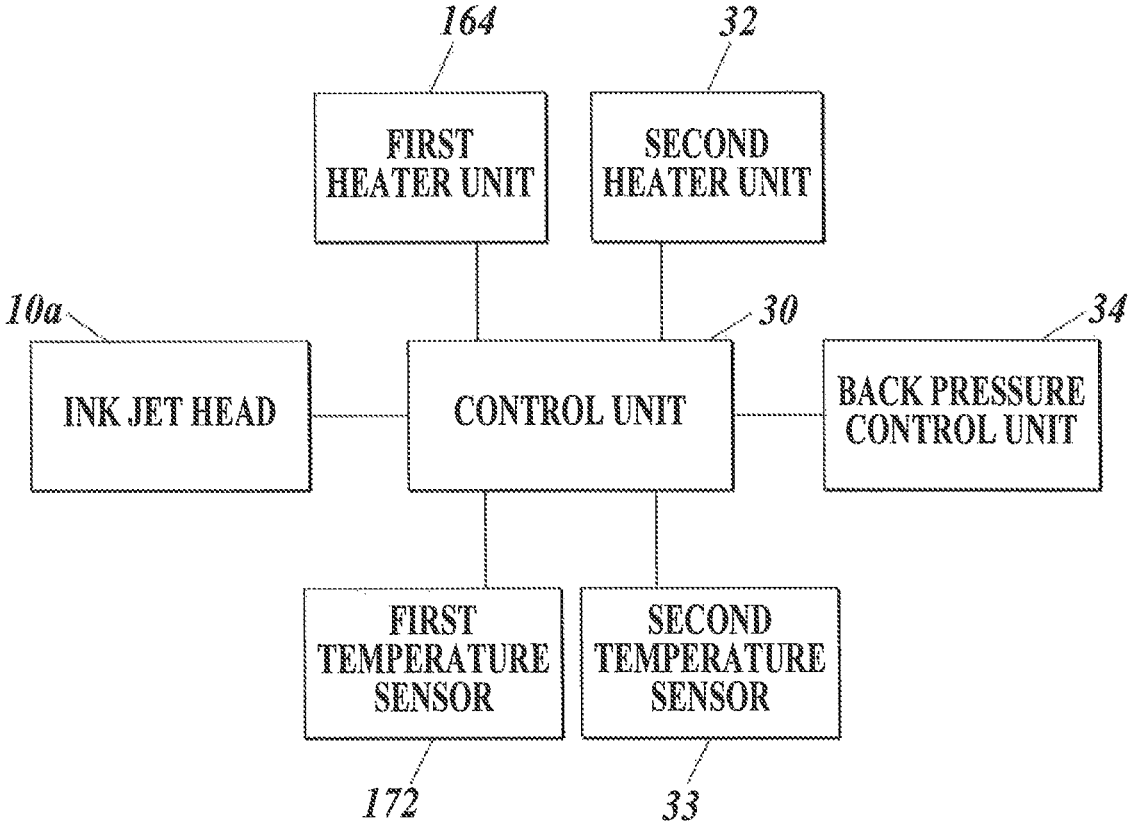
FIG. 22 is a block diagram showing main control configurations of the ink jet recording apparatus of FIG. 15.

FIG. 22 is a block diagram showing a main control configuration of the ink jet recording apparatus 100*a* of this embodiment. As shown in FIG. 22, the heads 10*a*, the first heater units 164, the second heater units 32, the first temperature sensors 172, the second temperature sensors 33, the back pressure control units 34 and the like are electrically connected to the control unit 30 of the ink jet recording apparatus 100*a*.

Each of the back pressure control units 34 controls the back pressure of the meniscus in the nozzles 152, and controls the meniscus so as to be capable of the injection. Specifically, the back pressure control unit 34 captures a value of the pressure sensor 341 attached to the ink tank, and at the time of the ejection, controls to perform the suction by the reversible pump 343 so that the back pressure of the meniscus in the nozzles 152 becomes a negative pressure.

The control unit 30 is configured to include a CPU (central processing unit) and a memory, and controls the respective constituent elements of the ink jet recording apparatus 100*a*. The memory stores data of the image to be formed on the recording medium 130, and a program for controlling the respective constituent elements of the ink jet recording apparatus 100*a*. The CPU performs an arithmetic operation based on the image data and the program, which are stored in the memory, and transmits control signals to the respective constituent elements based on this result of the arithmetic operation.

For example, in the case where the ink is cooled as at the time of standby, the control unit 30 turns the first heater unit 164 to an off state, and when a detection result of the first temperature sensor 172 becomes a predetermined temperature or less, turns the back pressure control to a standby state or a stopped state by the back pressure control unit 34, and in addition, also turns the second heater unit 32 to an off state. Meanwhile, in the case of heating the ink as at the time of the ink ejection, the control unit 30 turns the first heater unit 164 and the second heater unit 32 to an on state, and when the detection result of the first temperature sensor 172 becomes higher than a predetermined temperature, controls the back pressure of the meniscus in the nozzles 152 by the back pressure control unit 32, and starts the back pressure control so as to be capable of the injection.

Figure 23:
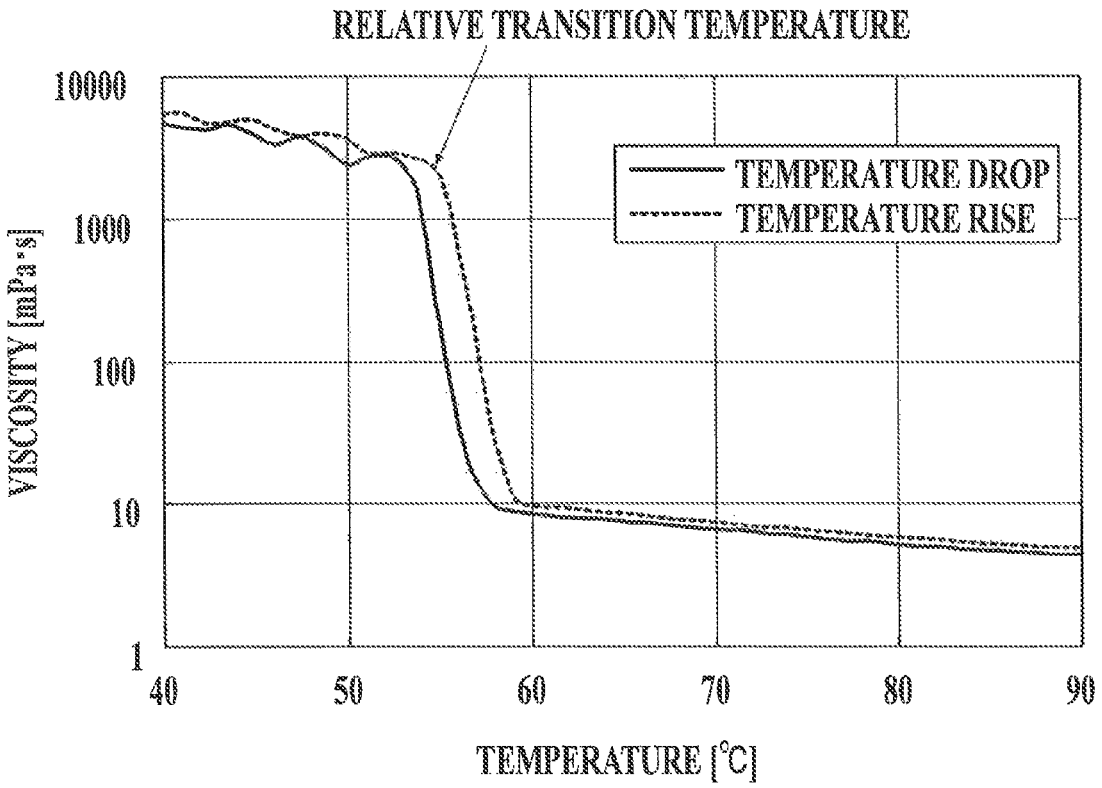
FIG. 23 is a viscosity-temperature chart showing properties of gel ink.
Figure 24:
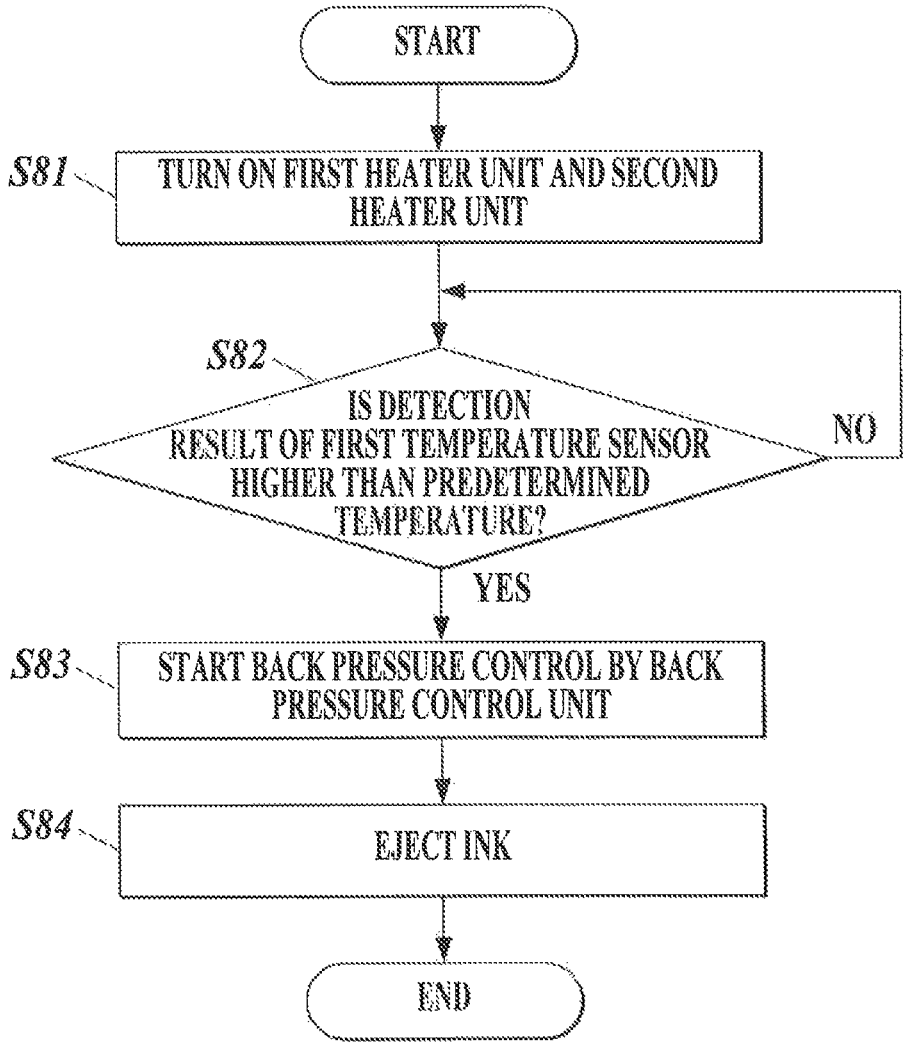
FIG. 24 is a flowchart showing a flow of ink heating to be executed in the ink jet recording apparatus of FIG. 15.

Here, as the predetermined temperature, different values are applied depending on types of the inks to be used in the ink jet recording apparatus 100*a*. For example, in the case where the ink is heat-meltable solid ink, a freezing point thereof is applied as the predetermined temperature. Moreover, in the case where the ink is gel ink, a relative transition temperature of an ink composition is applied as the predetermined temperature. Here, a gel state of the gel ink refers to a state where a lamella structure or a structure is provided, in which dissolved substances lose independent mobility and aggregate by a polymer network subjected to covalent bonding or hydrogen bonding, or by a polymer network formed by physical cohesion, and the ink concerned solidifies or semi-solidifies following a sharp increase of viscosity and a significant increase of elasticity. As an example, FIG. 23 is a viscosity-temperature chart of the gel ink. Gel ink of FIG. 23 causes a phase change/liquefies in a range from 50° C. to 60° C., viscosity thereof becomes approximately 7 cp to 8 cp from 70° C. to 80° C., and then becomes capable of being ejected smoothly. In terms of ejection stability and proofness of thermal polymerization, the relative transition temperature by sol-gel of the ink composition is preferably 40° C. or more to 100° C. or less, more preferably, 45° C. or more to 80° C. or less. If the relative transition temperature of the ink composition is 40° C. or more, then an image free from dot coalescence can be formed stably without being affected by a printing environment temperature. The relative transition temperature of the ink composition refers to a temperature at which the viscosity measured at a shear rate of 20 (1/S) by a viscosity/elasticity measurement device "physica MCR301" or the like sharply drops down.

Subsequently, a description is made of functions of the ink jet recording apparatus 100*a* of this embodiment.

First, a description is made of a flow at the time of heating the ink. In Step S81, the control unit 30 turns the first heater unit 164 and the second heater unit 32 to an on state.

In Step S82, the control unit 30 determines whether or not the detection result of the first temperature sensor 172 is higher than the predetermined temperature, then shifts to Step S83 in the case where the detection result is higher, and continues the temperature measurement in the case where the detection result is equal to or less than the predetermined temperature.

In Step S83, the control unit 30 controls the back pressure control unit 34 to start the control for the meniscus in the nozzles 152, and sets the back pressure to a negative pressure.

In Step S84, the control unit 30 controls the head 10*a* to execute the ink ejection.

Note that the predetermined temperature to be detected in Step S82 is a temperature in a state before the ink in the head becomes liquid completely though the ink is dissolved from solid since the ink is leaked from the nozzles or the air is entangled on the contrary when the ink becomes liquid in a state where the back pressure is not controlled.

Figure 25:
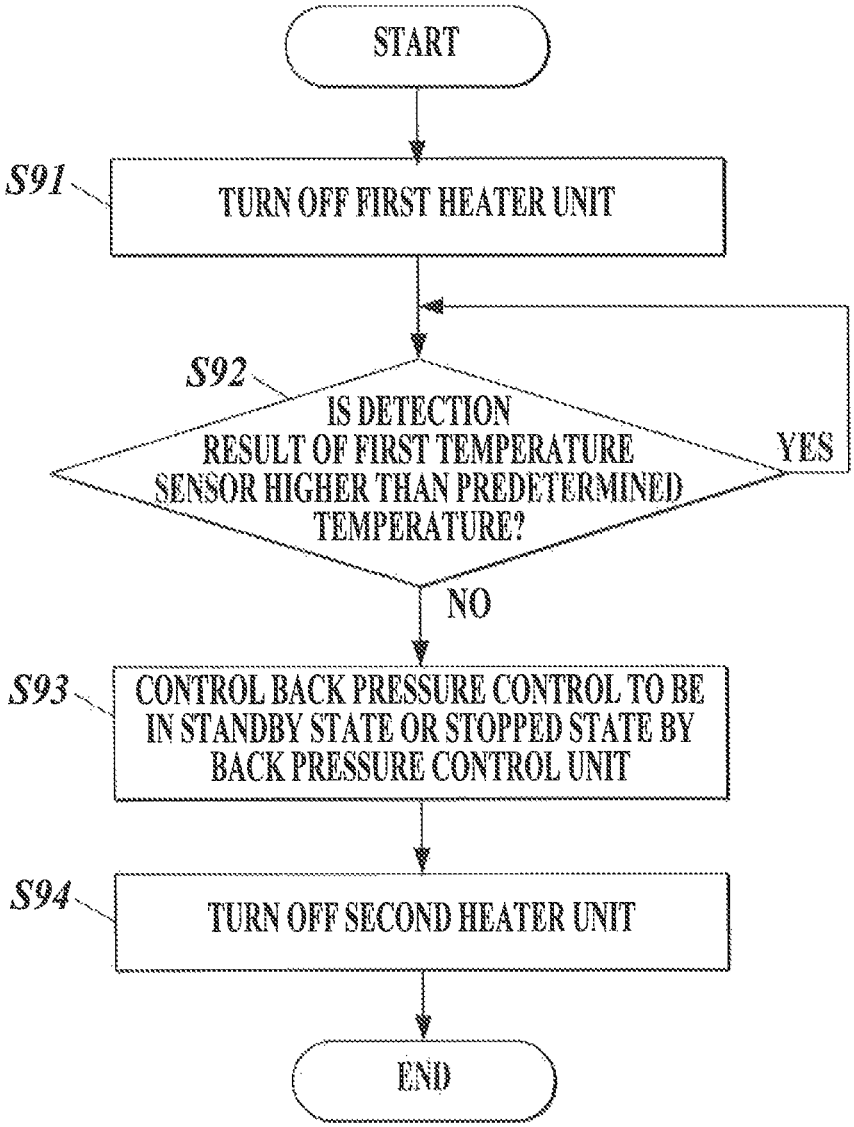
FIG. 25 is a flowchart showing a flow of ink cooling to be executed in the ink jet recording apparatus of FIG. 15.

Next, based on FIG. 25, a description is made of a flow at the time of cooling the ink after the ink ejection. In Step S91, the control unit 30 turns the first heater unit 164 to an off state.

In Step S92, the control unit 30 determines whether or not the detection result of the first temperature sensor 172 is higher than the predetermined temperature, then continues the temperature measurement in the case where the detection result is higher, and shifts to Step S93 in the case where the detection result is equal to or less than the predetermined temperature.

In Step S93, the control unit 30 controls the back pressure control unit 34 to be in a stopped state or a standby state, and stops the control for the meniscus in the nozzles 152. In Step S94, the control unit 30 turns the second heater unit 32 to an off state, and ends the cooling of the ink.

Note that the predetermined temperature of this Step S92 is a temperature when the ink is in a gel form.

As described above, in accordance with this embodiment, in the case where the ejection operation is paused and the ink is cooled, the first heater unit 164 is turned to the off state, and when the detection result of the first temperature sensor 172 becomes the predetermined temperature or less, the back pressure control is turned to the stopped state or the standby state by the back pressure control unit 34, and in addition, the second heater unit 32 is also turned to the off state. Accordingly, the back pressure control can be turned to the stopped state or the standby state so that the ink can be cooled sufficiently, and that the viscosity of the ink can be sufficiently high. In such a way, the ink can be prevented from being extruded from the nozzles 152, and it is made possible to suppress the ink from being consumed wastefully.

Moreover, in the event where the ink is cooled, it is also apprehended that the air may be entangled from the nozzles 152 owing to volume shrinkage of the ink; however, since the back pressure at the ejection time is maintained until the ink is cooled sufficiently, it is also possible to prevent air mixing from the nozzles 152. In such a way, an ejection failure that is based on ink mixing can also be prevented.

Moreover, in the case of heating the ink, the first heater unit 164 and the second heater unit 32 are turned to the on state, then when the detection result of the first temperature sensor 172 becomes higher than the predetermined temperature, the back pressure control is started by the back pressure control unit 34, and the meniscus in the nozzles 152 is controlled, and accordingly, such a state can be brought where it is possible to eject the ink efficiently without consuming the ink wastefully.

Then, the top plate 170 is formed of the raw material higher in thermal conductivity than the ink tanks 250 and the ink flow passages 260, and accordingly, the ink on the nozzle 152 side can be first heated/cooled, and it is made possible to efficiently prevent the leakage of the ink from the nozzles.

Note that the present invention is not limited to the above-described embodiments and is appropriately changeable. In the following description, the same reference numerals are assigned to the same portions as those of the above-described embodiments, and a description thereof is omitted.

For example, in the above-described embodiments, the case where the back pressure control unit 34 controls the meniscus by the pump 343 is illustrated; however, besides, pressure adjusting means such as a compressor is also usable. Moreover, besides using the pressure adjusting means, the ink tank 250 is elevated and lowered, and a difference of elevation between the ink tank 250 and the head 10*a* is adjusted, whereby it is also possible to control the meniscus in the nozzles 152.

Figure 26:
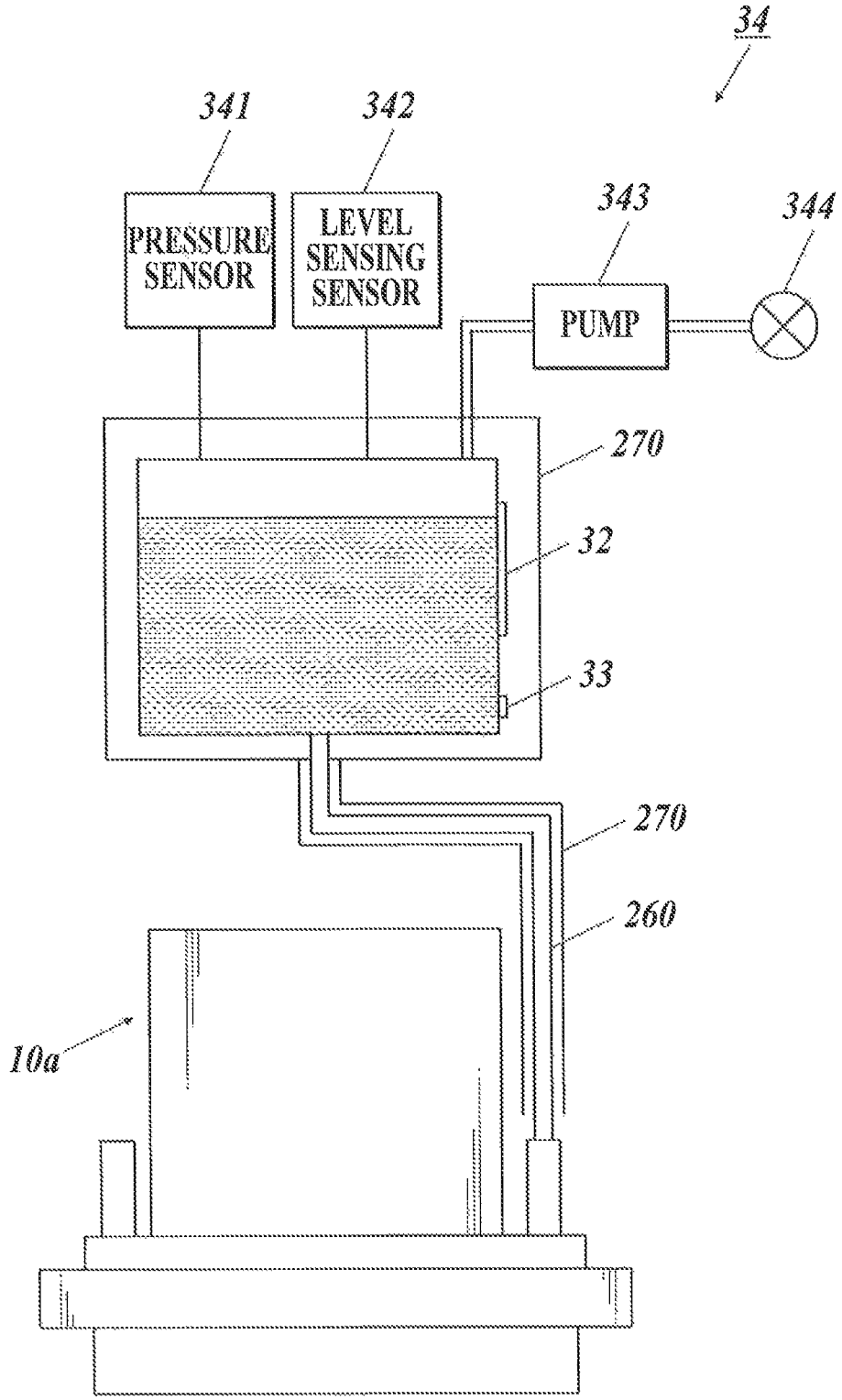
FIG. 26 is a schematic view showing a modification example of the ink tank and ink flow passages, which are provided in the ink jet recording apparatus of FIG. 15.

Moreover, as shown in FIG. 26, in terms of performing the temperature control for the ink, it is preferable to adopt a heat insulation structure by surrounding the ink tank 250 and the ink flow passage 260 by a heat insulation material 270 since an influence of the external air can be suppressed.

Figure 27A:
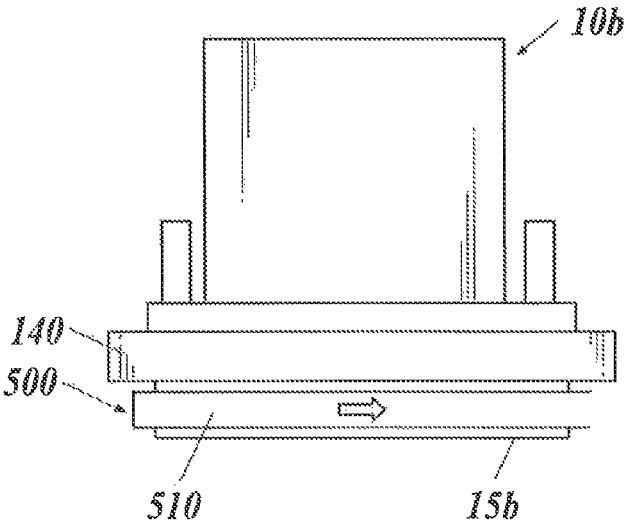
FIG. 27A is a schematic view showing a modification example of the ink jet head of FIG. 16.
Figure 27B:
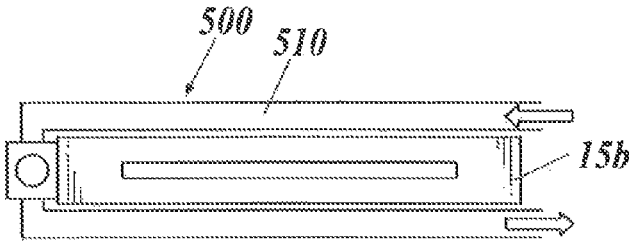
FIG. 27B is a schematic view showing the modification example of the ink jet head of FIG. 16.
Figure 27C:
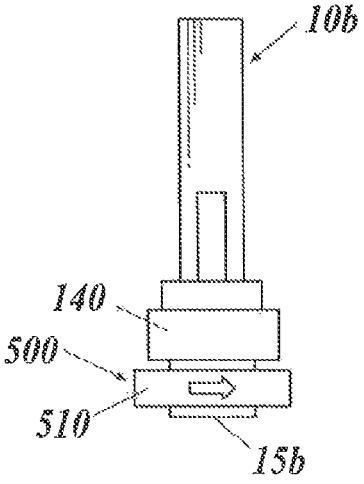
FIG. 27C is a schematic view showing the modification example of the ink jet head of FIG. 16.

Moreover, temperature adjusting means for forcibly cooling/heating ink in a head 10*b* may be further provided. FIGS. 27A, 27B and 27C are explanatory views showing a schematic configuration of an ink jet head that mounts the temperature adjusting means thereon: FIG. 27A is a side view; FIG. 27B is a bottom view; and FIG. 27C is a front view. As shown in FIGS. 27A, 27B and 27C, temperature adjusting means 500 is provided under the head 10*b*. The temperature adjusting means 500 is attached to the cabinet frame 140 so as to surround the manifold 160. The temperature adjusting means 500 includes a guide pipe 510 through an inside of which cold water or hot water flows, and this guide pipe 510 is arranged on the periphery of the cabinet frame 140. To this guide pipe 510, connected is a liquid supply unit (not shown) that circulates liquid in the guide pipe 510 concerned. The liquid supply unit has a function to heat or cool the liquid, and decides whether to heat or cool the liquid based on the control of the control unit 30.

For example, in the above-described embodiment, the description has been made while illustrating the case of attaching the temperature adjusting means 500 so as to surround the cabinet frame 140 thereby; however, it is also possible to attach the temperature adjusting means 500 so as to surround the manifold 160 in the inside of the cabinet frame 140 thereby.

Figure 28:
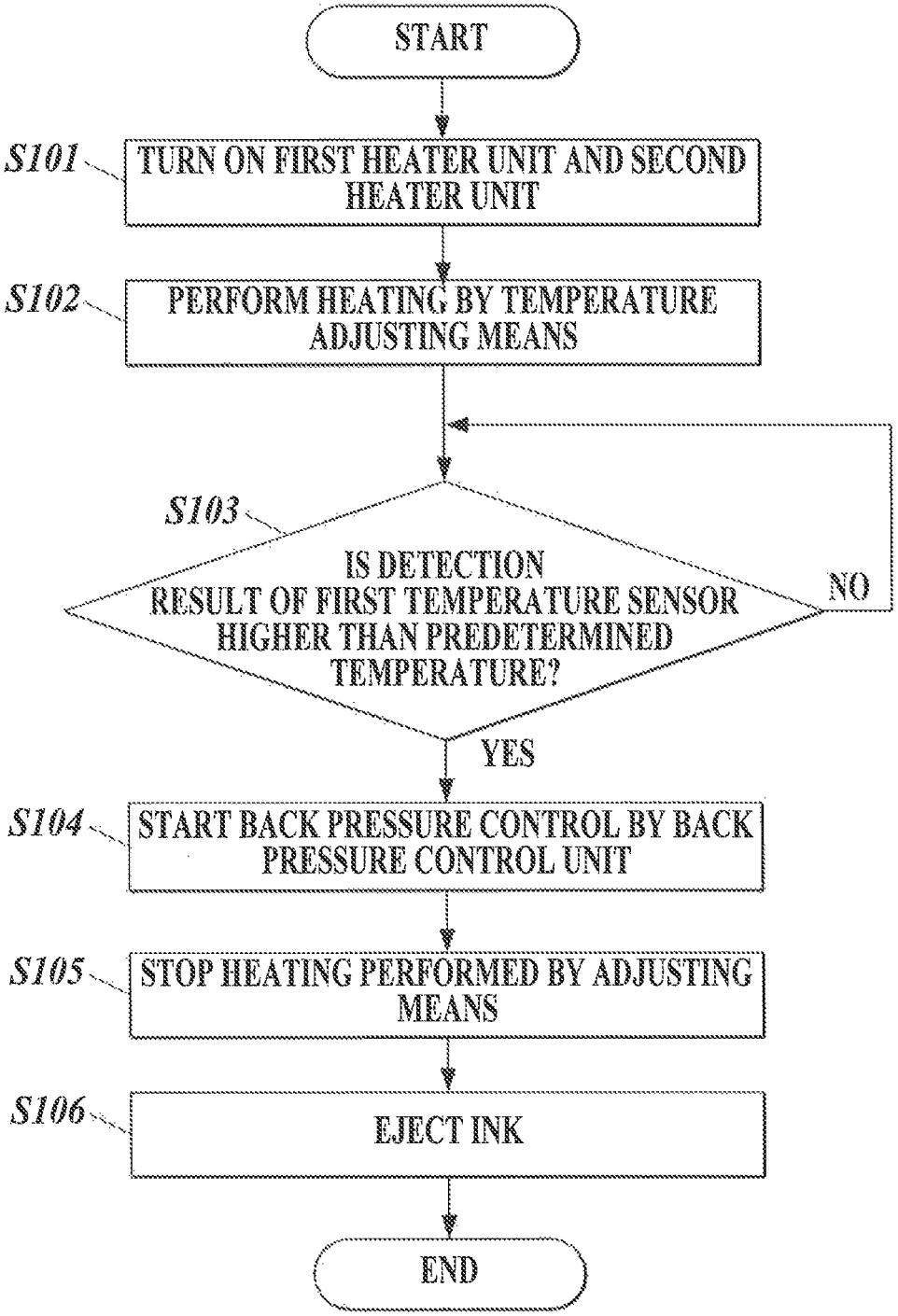
FIG. 28 is a flowchart showing a flow of ink heating in a case of using the ink jet head shown in FIGS. 27A, 27B and 27C.

Then, at the heating time, as shown in FIG. 28, the control unit 30 turns the first heater unit 164 and the second heater unit 32 to the on state in Step S101.

In Step S102, the control unit 30 controls the liquid supply unit of the temperature adjusting means 500 to circulate the heated liquid through an inside of the guide pipe 510. In such a way, the ink in the manifold 160 is also heated.

In Step S103, the control unit 30 determines whether or not the detection result of the first temperature sensor 172 is higher than a predetermined temperature, shifts to Step S104 in the case where the detection result is higher, and continues the temperature measurement in the case where the detection result is the predetermined temperature or less.

In Step S104, the control unit 30 controls the back pressure control unit 34 to start the back pressure control, and controls the meniscus in the nozzles.

In Step S105, the control unit 30 controls the liquid supply unit of the temperature adjusting means 500, and stops the heating performed by the temperature adjusting means 500.

In Step S106, the control unit 30 controls the head 10*b* to execute the ink ejection.

Figure 29:
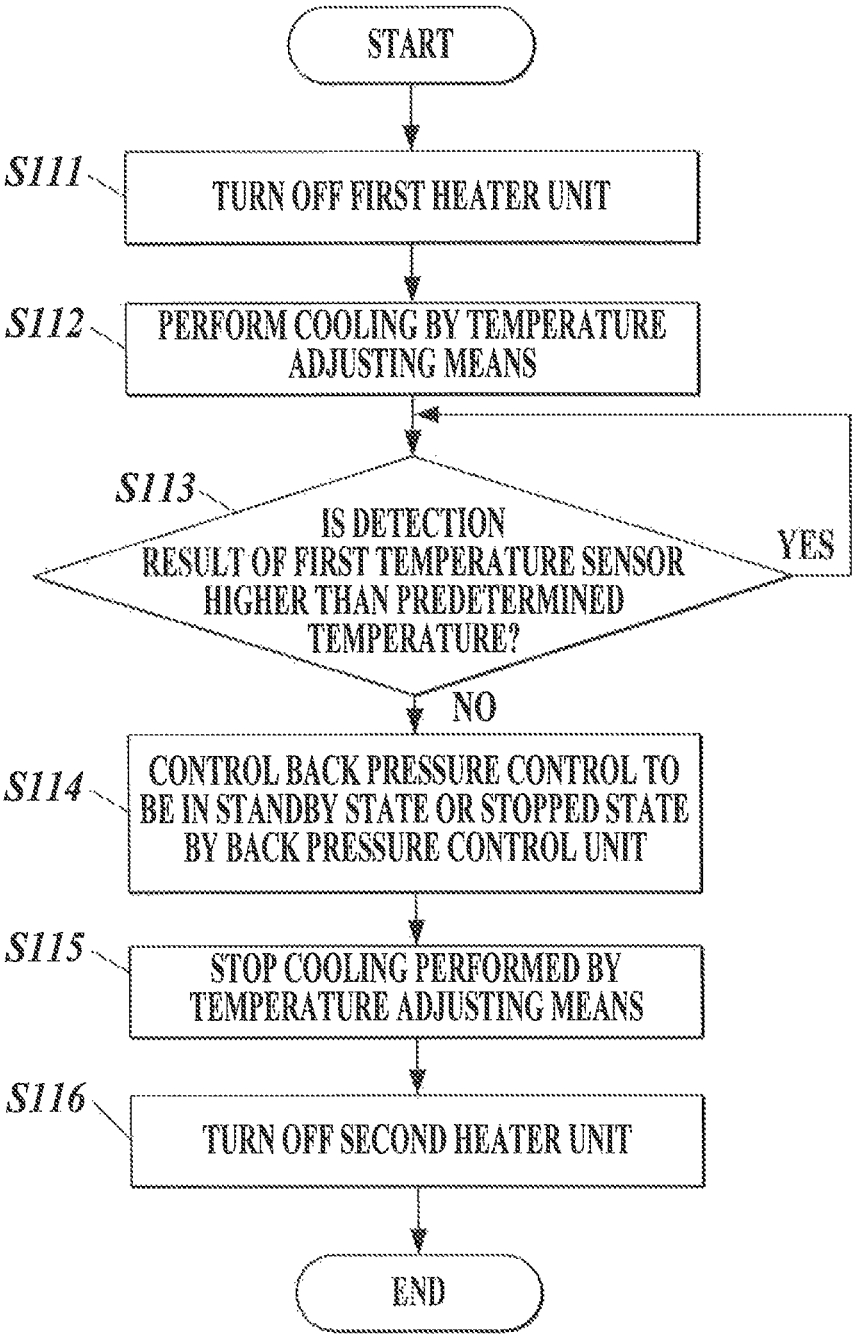
FIG. 29 is a flowchart showing a flow of ink cooling in the case of using the ink jet head shown in FIGS. 27A, 27B and 27C.

Meanwhile, at the cooling time, as shown in FIG. 29, the control unit 30 turns the first heater unit 164 to the off state in Step S111.

In Step S112, the control unit 30 controls the liquid supply unit of the temperature adjusting means 500 to circulate the cooled liquid through the inside of the guide pipe 510. In such a way, the ink in the manifold 160 is also cooled.

In Step S113, the control unit 30 determines whether or not the detection result of the first temperature sensor 172 is higher than a predetermined temperature, continues the temperature measurement in the case where the detection result is higher, and shifts to Step S114 in the case where the detection result is the predetermined temperature or less.

In Step S114, the control unit 30 controls the back pressure control unit 34 to be in the stopped state or the standby state, and stops the control for the meniscus in the nozzles 152.

In Step S115, the control unit 30 controls the liquid supply unit of the temperature adjusting means 500, and stops the cooling performed by the temperature adjusting means 500.

In Step S116, the control unit 30 turns the second heater unit 32 to the off state, and ends the cooling for the ink.

As described above, at the time of heating the ink, the heating by the temperature adjusting means 500 is executed, and at the time of cooling the ink, the cooling by the temperature adjusting means 500 is executed. Accordingly, it is made possible to perform the temperature adjustment for the ink rapidly.

INDUSTRIAL APPLICABILITY

The present invention is configured as described above, and accordingly, can be used for an ink jet recording apparatus, an ink supply method, a power shutdown method, and a method of shutting down a temperature adjustment unit of the ink jet recording apparatus.

EXPLANATION OF REFERENCE NUMERALS

8 CONTROL UNIT (PRESSURE ADJUSTMENT UNIT, TEMPERATURE ADJUSTMENT UNIT, AIR SUPPLY/EXHAUST CONTROL UNIT, POSITION CONTROL UNIT)
10, 10*a*, 10*b* HEAD
11 MAIN TANK (RESERVOIR UNIT)
12 SUB-TANK (RESERVOIR UNIT)
13 INK FLOW PASSAGE (FLOW PASSAGE PORTION)
14 LIQUID FEED PUMP (PUMP)
15 AIR CHAMBER (CHAMBER)
16 COMPRESSION VACUUM PUMP
18 AIR PRESSURE SENSOR (PRESSURE DETECTION UNIT)
20 INK FLOW PASSAGE (FLOW PASSAGE PORTION)
22 TANK HEATING UNIT
22*s* TEMPERATURE SENSOR
23 FLOW PASSAGE HEATING UNIT
23*s* TEMPERATURE SENSOR
24 HEAD HEATING UNIT
24*s* TEMPERATURE SENSOR
26 INPUT OPERATION UNIT (INPUT UNIT)
58 AIR CYLINDER (VERTICAL MOTION MECHANISM)
100, 100*a* INK JET PRINTER (INK JET RECORDING APPARATUS)
333 CARRIAGE
444 CARRIAGE RAIL
5 MOISTURE RETENTION UNIT
6 MOISTURE RETENTION CAP
7 MAINTENANCE UNIT
88 SUCTION CAP
9 SUCTION PUMP
110 DISCARDED INK TANK
111 CLEANING BLADE
120 INK RECEIVER
130 RECORDING MEDIUM
140 CABINET FRAME
150 HEAD CHIP
15*b* NOZZLE SURFACE
160 MANIFOLD
170 TOP PLATE
180 FLEXIBLE WIRING BOARD
190 DRIVE CIRCUIT BOARD
210 EXTERNAL CONNECTOR
240 COVER
250 INK TANK (RESERVOIR UNIT)
260 INK FLOW PASSAGE
270 HEAT INSULATION MATERIAL
30 CONTROL UNIT
32 SECOND HEATER UNIT (SECOND HEATING MEANS)
33 SECOND TEMPERATURE SENSOR
34 BACK PRESSURE CONTROL UNIT (RESERVOIR UNIT PRESSURE ADJUSTMENT UNIT)
500 TEMPERATURE ADJUSTING MEANS
510 GUIDE PIPE
141 SUPPLY-USE CONNECTION PORTION
142 DRAINAGE-USE CONNECTION PORTION
151 WIRING BOARD
152 NOZZLE
161 INTRODUCTION-USE INK PORT
162 DRAINAGE-USE INK PORT
164 FIRST HEATER UNIT
171 SLIT
172 FIRST TEMPERATURE SENSOR (TEMPERATURE SENSOR)
173 FLEXIBLE WIRING BOARD

The invention claimed is:

1. An ink jet recording apparatus comprising:

a head that ejects droplets of ink in which there is a hysteresis in phase transition temperature and in which a freezing point is lower than a melting point;

a flow passage portion for supplying the ink to the head, the flow passage portion including, in a part thereof, a reservoir unit that reserves the ink; and a temperature adjustment unit capable of adjusting temperatures of the flow passage portion and the head independently of each other, wherein the temperature adjustment unit is configured to adjust temperatures of the head and the flow passage portion to turn the ink in the head to liquid after turning the ink in the flow passage portion to liquid, and thereafter, control a temperature of the ink in the flow passage portion to maintain a temperature higher than the freezing point of the ink and lower than the melting point of the ink so that the ink in the flow passage portion does not become solid from liquid in a printing enabled state of the inkjet recording apparatus.

2. The ink jet recording apparatus of claim 1, wherein the temperature adjustment unit is configured to, after turning the ink in the head to liquid, control a temperature of the ink in the head to maintain the temperature higher than the freezing point of the ink in the head and lower than the melting point of the ink so that the ink in the head does not become solid from liquid in the printing enabled state of the inkjet recording apparatus.

3. The ink jet recording apparatus of claim 1, wherein the temperature adjustment unit is configured to, while monitoring the temperatures of both of the flow passage portion and the head, control the temperatures so that the temperature of the flow passage portion becomes higher than the temperature of the head.

4. The inkjet recording apparatus of claim 1, wherein the reservoir is a first tank that reserves the ink, and the flow passage includes an ink flow passage that connects the first tank with the head.

5. The ink jet recording apparatus of claim 4, wherein the temperature adjustment unit is configured to, after turning the ink in the head to liquid, control a temperature of the ink in the head to maintain the temperature higher than the freezing point of the ink in the head and lower than the melting point of the ink in the printing enabled state of the inkjet recording apparatus.

6. The ink jet recording apparatus of claim 4, wherein the temperature adjustment unit is configured to, while monitoring the temperatures of both of the flow passage portion and the head, control the temperatures so that the temperature of the flow passage portion becomes higher than the temperature of the head.

7. The ink jet recording apparatus of claim 5, further comprising:

a reservoir unit pressure adjustment unit that adjusts a pressure to be applied to the ink in the reservoir unit, wherein the temperature adjustment unit is configured to, after adjusting the pressure by the reservoir unit pressure adjustment unit, and turning the ink in the flow passage portion from solid to liquid, control the temperatures of the flow passage portion and the head so that the ink in the head becomes liquid from solid.

8. The ink jet recording apparatus of claim 7, wherein the reservoir unit pressure adjustment unit performs control to adjust the pressure to be applied to the ink in the head before the ink in the head becomes liquid.

9. The inkjet recording apparatus of claim 8, further comprising heaters that heat the head and the ink flow passage, respectively, wherein the temperature adjustment unit adjusts ink temperature of the head and the ink flow passage independently of each other by controlling the heaters.

10. The inkjet recording apparatus of claim 9, further comprising a second tank that is between the first tank and the head, wherein the first tank is connected to the head by the ink flow passage and the second tank.

11. The ink jet recording apparatus of claim 10, wherein the ink contains at least an oil gelling agent and an active ray curable composition that cures by an active ray.

12. The ink jet recording apparatus of claim 2, further comprising:

a reservoir unit pressure adjustment unit that adjusts a pressure to be applied to the ink in the reservoir unit, wherein the temperature adjustment unit is configured to, after adjusting the pressure by the reservoir unit pressure adjustment unit, and turning the ink in the flow passage portion from solid to liquid, control the temperatures of the flow passage portion and the head so that the ink in the head becomes liquid from solid.

13. The ink jet recording apparatus of claim 12, wherein the reservoir unit pressure adjustment unit performs control to adjust the pressure to be applied to the ink in the head before the ink in the head becomes liquid.

14. The ink jet recording apparatus of claim 13, wherein the ink contains at least an oil gelling agent and an active ray curable composition that cures by an active ray.

15. The inkjet recording apparatus of claim 1, further comprising:

a first sensor which detects a temperature of the head; and a second sensor which detects a temperature of the flow passage portion.

16. The inkjet recording apparatus of claim 1, wherein the temperature adjustment unit comprises:

a head heating unit that heats the head to transmit heat to the ink; and a flow passage portion heating unit that heats the flow passage portion to transmit heat to the ink.

17. The inkjet recording apparatus of claim 15, wherein the head comprises the first sensor.

18. The inkjet recording apparatus of claim 15, wherein the flow passage portion comprises the second sensor.

* * * * *